US009782682B2

(12) United States Patent
Frankowski et al.

(10) Patent No.: US 9,782,682 B2
(45) Date of Patent: Oct. 10, 2017

(54) WET PLAY STRUCTURE INCLUDING A NON-HARNESSED COURSE AND A HARNESSED COURSE

(75) Inventors: Hyuma Alexei Frankowski, Vancouver (CA); Tat K. Won, North Vancouver (CA); James A. Liggett, Martin, MI (US)

(73) Assignee: Whitewater West Industries Ltd., Richmond BC (CA)

( * ) Notice: Subject to any disclaimer, the term of this patent is extended or adjusted under 35 U.S.C. 154(b) by 24 days.

(21) Appl. No.: 13/252,925

(22) Filed: Oct. 4, 2011

(65) Prior Publication Data

US 2012/0083350 A1 Apr. 5, 2012

Related U.S. Application Data

(60) Provisional application No. 61/389,623, filed on Oct. 4, 2010, provisional application No. 61/416,716, filed on Nov. 23, 2010.

(51) Int. Cl.
*A63G 31/00* (2006.01)

(52) U.S. Cl.
CPC ..... *A63G 31/00* (2013.01); *A63G 31/007* (2013.01)

(58) Field of Classification Search
CPC ..... A63G 31/00; A63G 31/007; A63C 19/10; A63B 69/18
USPC ..... 472/128, 116, 117; 482/51
See application file for complete search history.

(56) References Cited

U.S. PATENT DOCUMENTS

| | | | | |
|---|---|---|---|---|
| 5,820,471 | A | 10/1998 | Briggs | |
| 5,865,680 | A | 2/1999 | Briggs | |
| 6,360,669 | B1 * | 3/2002 | Albrich | 104/93 |
| 6,569,023 | B1 | 5/2003 | Briggs | |
| 6,761,637 | B2 * | 7/2004 | Weston et al. | 463/42 |
| 7,175,534 | B2 | 2/2007 | Liggett | |
| 7,309,302 | B1 * | 12/2007 | Phillips | 482/35 |
| 7,381,137 | B2 | 6/2008 | Steele et al. | |
| 7,416,054 | B2 | 8/2008 | Liggett | |
| 7,614,957 | B2 * | 11/2009 | Lickle | 472/89 |
| 7,785,207 | B2 * | 8/2010 | Henry et al. | 472/128 |
| 7,981,004 | B2 | 7/2011 | Liggett et al. | |
| 8,016,686 | B2 | 9/2011 | Liggett et al. | |
| 8,066,578 | B2 | 11/2011 | Liggett | |
| 2006/0090960 | A1 | 5/2006 | Liggett | |
| 2006/0135272 | A1 | 6/2006 | Liggett | |

(Continued)

OTHER PUBLICATIONS www.spectrumsports.com; webpage showing ROPE-A-PHOBIA; 2004.

*Primary Examiner* — Michael Dennis
(74) *Attorney, Agent, or Firm* — Greenberg Traurig, LLP

(57) ABSTRACT

A wet play structure including a non-harnessed course and a harnessed course. The wet play structure can be located in an amusement park. The non-harnessed course and the harnessed course can be completely, or partially integrated to increase interaction between users. The wet play structure may include an elevated path configured to allow a user to traverse the elevated path. A track is configured to connect to a harness worn by the user while the user traverses the elevated path. In one aspect, the wet play structure may include a fluid conduit configured to transmit water onto the user while the user traverses the elevated path. In one aspect, a pool positioned beneath the elevated path and configured to contain water.

13 Claims, 42 Drawing Sheets

(56) References Cited

U.S. PATENT DOCUMENTS

| | | | | |
|---|---|---|---|---|
| 2006/0157298 | A1* | 7/2006 | Beggrow | A62B 35/0056 182/36 |
| 2006/0189453 | A1 | 8/2006 | Leblond | |
| 2007/0191123 | A1 | 8/2007 | Liggett | |
| 2009/0065300 | A1 | 3/2009 | Liggett | |
| 2009/0069104 | A1 | 3/2009 | Liggett | |
| 2009/0078148 | A1* | 3/2009 | Cylvick | 104/53 |
| 2011/0111871 | A1* | 5/2011 | Legary et al. | 472/128 |

* cited by examiner

WET PLAY STRUCTURE INCLUDING A NON-HARNESSED COURSE AND A HARNESSED COURSE

RELATED APPLICATIONS

This application claims the benefit and priority of U.S. Provisional Patent Application Ser. No. 61/389,623, filed on Oct. 4, 2010, entitled "WET PLAY STRUCTURE INCLUDING A NON-HARNESSED COURSE, A HARNESSED COURSE, AND A ZIP-LINE SECTION," and U.S. Provisional Patent Application Ser. No. 61/416,716, filed on Nov. 23, 2010, entitled "WET PLAY STRUCTURE INCLUDING A NON-HARNESSED COURSE, A HARNESSED COURSE, AND A ZIP-LINE SECTION," both of which are hereby incorporated by reference in their entireties.

FIELD

The present invention relates to a wet play structure including a non-harnessed course and a harnessed course.

BACKGROUND

The popularity of family-oriented water theme parks and recreational water facilities has increased dramatically in the last decade. Water parks have proliferated as adults and children, alike, seek the thrill and entertainment of water parks as a healthy and enjoyable way to cool off in the hot summer months.

Most water theme parks, like their dry counterparts, consist primarily of ride attractions. The most popular among these are water slides in which participants slide down a wet trough or tunnel and splash down into a pool of water. As demand for such water attractions has increased, water parks have continued to evolve ever larger and more complex water slides to thrill and entertain growing numbers of water play participants. Other popular ride attractions include surfing wave simulators, log flumes and white-water rafting.

Although these water ride attractions are very popular, they lack interactivity and do not encourage the user to participate with the attraction. Often, the user of these water ride attractions sits passively on an inner tube or other vehicle as they are conveyed along a slide surface or track.

SUMMARY

The present invention relates to a wet play structure including a non-harnessed course, and a harnessed course. The wet play structure may additionally include a zip-line section. The wet play structure can be located, for example, in an amusement park. The non-harnessed course, the harnessed course, and the zip-line section can be completely, or partially integrated to increase interaction between users. The integration can also increase capacity of the wet play structure. However, the non-harnessed course, the harnessed course, and/or the zip-line section can also be formed serially or as stand alone units. In addition, the non-harnessed course, the harnessed course, and the zip-line section can be multi-leveled to allow for a greater vertical participant density. Greater vertical participant density can improve the profitability of the amusement park given limited land available upon which to include features. The non-harnessed course, the harnessed course, and the zip-line section can also be built over or integrated onto existing park attractions in order to improve vertical participant density. Such an arrangement can help to reduce congestion in the park by providing multiple alternate paths for users to go from one attraction to another attraction. A reduction in congestion at attractions improves the overall enjoyment of the amusement park users by allowing them to get from one amusement park attraction to another in the shortest time possible.

The non-harnessed course, the harnessed course, and the zip-line section of the wet play structure can also provide various thrill levels to address the needs of users who have different thrill tolerances. This can attract more users to the wet play structure since people who have different thrill tolerances can find a feature which is suitable for them. For example, the non-harnessed course can be for people who want little or no thrill, the harnessed course can be for people who want a moderate to high level of thrill, and the zip-line section can be for people who want the highest amount of thrill.

In addition, the variety of thrill levels and the interconnection between the non-harnessed course, the harnessed course, and/or the zip line section may allow groups of people who have different thrill tolerances to traverse the wet play structure in relatively close proximity to each other. This is beneficial, for example, for families where members of the family may have different thrill tolerances.

With the wet play structure of the present invention, the families can utilize different portions of the wet play structure and still traverse the wet play structure together. For example, one member of the family could wander through the non-harnessed course, while another member of the family wanders through the harnessed course. However, since the harnessed course and the non-harnessed course can be integrated, the member of the family in the non-harnessed course can walk through the wet play structure at the same time as the member of the family in the harnessed course. In some instances, the member of the family in the non-harnessed course can talk or interact with the member of the family in the harnessed course throughout the harnessed course. For example, the members of the families can interact with each other using interactive units such as water guns, games, or other forms of interactive entertainment. This can improve the enjoyment of the wet play structure by the family as members can share experiences together and none of the members will be left out.

The harnessed course section of the wet play structure can include a harness system which allows users to move around a track while wearing a harness that is connected to a guide track by means of a lanyard attached between the harness and the guide track and a puck or other guide mechanism that receives that end of the lanyard to be located within the guide track to allow the user to move in a controlled manner throughout the harness course section of the wet play structure. The harnessed course section of the wet play structure may include various obstacles which can be ordinarily challenging, but that can be tried with minimal risk of bodily harm due to the safety provided by the harness system. This can be extremely thrilling for the user because the user can attempt otherwise potentially risky tasks or maneuvers with confidence because in the event that the user fails to successfully complete such a task or maneuver due to losing his balance or footing, the user recognizes that he will not suffer a serious injury from an uncontrolled impact with the ground or base of the wet play structure. In addition, the harness, the lanyard, and/or the puck can be configured to seamlessly transition onto a zip-line in the zip-line section of the wet play structure such that the user does not have to remove the harness or even the puck. This can also improve the comfort of the user as he does not have to expend energy removing and putting on multiple harnesses. In addition, it can also improve the flow of the harnessed course and the zip-line sections of the wet play structure since users will not have to spend time removing and putting on multiple harnesses. This can improve, for example, a capacity of the wet play structure and/or the amusement park.

The harness system can also include a radio-frequency identification (RFID) system which can be used to provide a customized interactive experience for the user. For example, depending on the user's preferences, various interactive units in the form of fluid conduits can spray water with more or less intensity and/or more or less quantities of water. This can again increase the experience of the user and even attract more users since users who want more thrills can receive more thrills, while a user who wants less thrills can receive less thrills without fear of receiving more thrills.

In one embodiment, the present invention is a wet play structure including a non-harnessed course section, a harnessed course section connected to the non-harnessed course, and a zip-line section connected to the harnessed course section. In another embodiment, the harnessed course section of the wet play structure can include a track configured to connect to a harness, the zip-line section can include a zip-line configured to connect to the harness, and the track and the zip-line can be configured to allow the harness to seamlessly transition from the track to the zip-line. The harness can include a first RFID unit, while the track can include a second RFID unit.

In one embodiment, the present invention is a wet play structure including an elevated path configured to allow a user to traverse the elevated path. A track is configured to connect to a harness worn by the user while the user traverses the elevated path. A fluid conduit is configured to transmit water onto the user while the user traverses the elevated path.

In one embodiment, the present invention is a wet play structure including an elevated path configured to allow a user to traverse the elevated path. A track is configured to connect to a harness worn by the user while the user traverses the elevated path. A pool is positioned beneath the elevated path and is configured to contain water.

BRIEF DESCRIPTION OF THE DRAWINGS

The features, objects, and advantages of the present invention will become more apparent from the detailed description set forth below when taken in conjunction with the drawings, wherein.

DETAILED DESCRIPTION

Figure 1B:
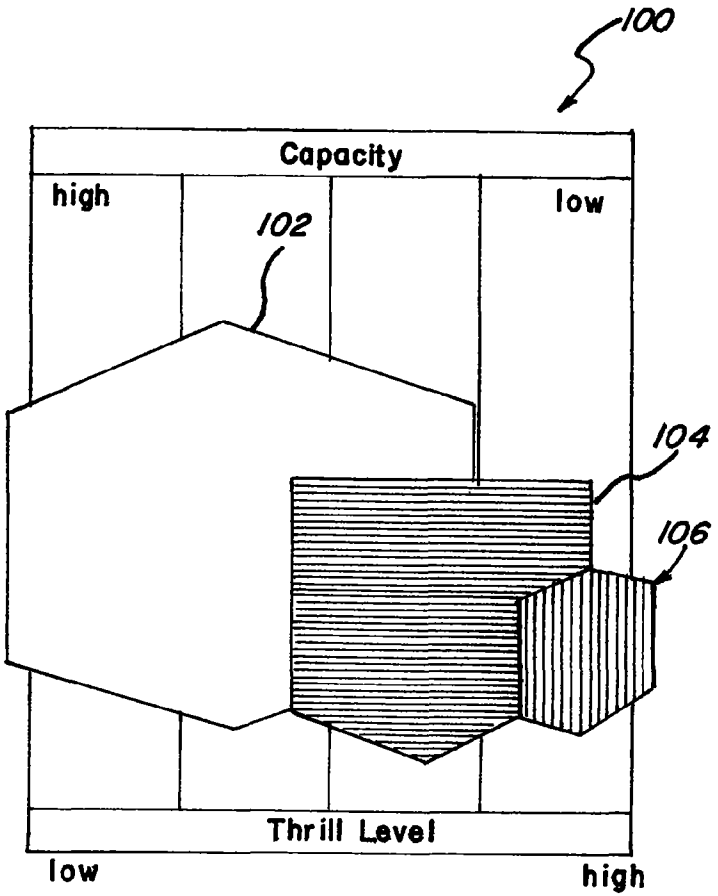
FIGS. 1A and 1B are diagrams of a wet play structure according to an embodiment of the present invention.
Figure 1A:
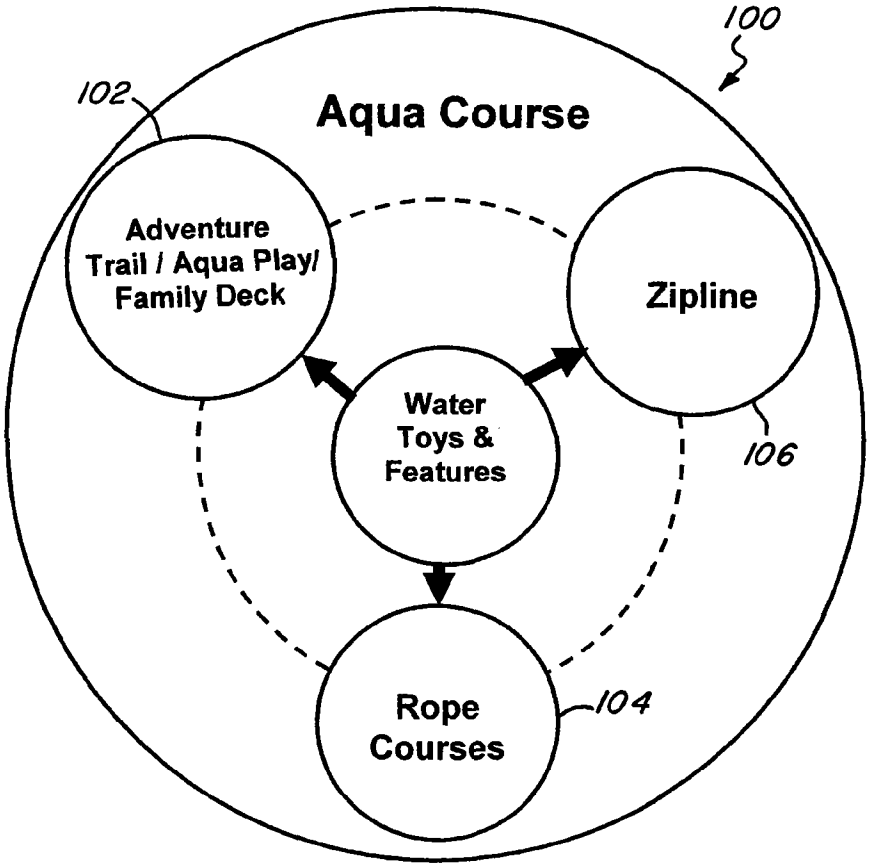

The detailed description of exemplary embodiments herein makes reference to the accompanying drawings and pictures, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

In one embodiment, the present invention is a wet play structure 100 as shown in FIG. 1A, FIG. 1B, FIG. 2, FIG. 3A, FIG. 3B, FIG. 4, FIG. 5A, and FIG. 5B. The wet play structure 100 can be implemented in a park, such as an amusement park. The wet play structure 100 can include, for example, a non-harnessed course 102, a harnessed course 104, and/or a zip-line section 106. The non-harnessed course 102, the harnessed course 104, and/or the zip-line section 106 can be implemented as stand alone units, integrated units, or partially integrated units. The non-harnessed course 102 can allow users to wander around and/or interact with various features without harnesses, while the harnessed course 104 can allow users to wander around and/or interact with various features with harnesses. The zip-line section 106 can allow users to ride a zip-line using harnesses, such as the harnesses in the harnessed course 104.

The wet play structure 100 can include interactive units, such as fluid conduits in the form of water toys and features integrated in the non-harnessed course 102, the harnessed course 104, and/or the zip-line section 106. In one embodiment, the non-harnessed course 102 can be, an AquaPlay™ course, which is owned by Whitewater West Industries Ltd. The non-harnessed course 102 may also be referred to as a Adventure Trail or a Family Deck. The harnessed course 104 can be, for example, a ropes course, which is owned by Ropes Courses, Inc. The ropes course can be, for example, the ropes course or portions of the ropes course disclosed in Liggett, U.S. Pat. No. 7,175,534 entitled "CHALLENGE COURSE" and/or Liggett, U.S. Patent Pub. No. 2007/0191123 entitled "CHALLENGE COURSE," which are hereby incorporated by reference in their entirety. In addition, the wet play structure can be, for example, an AquaCourse™ structure, which is owned by Whitewater West Industries Ltd. However, such embodiments are merely exemplary.

In one embodiment, the non-harnessed course 102, the harnessed course 104, and/or the zip-line section 106 can be formed to maximize and/or increase user interaction. This can include pathways of the non-harnessed course 102, the harnessed course 104, and/or the zip-line section 106 that intersect into each other, resulting in multiple points of overlapping, face-to-face encounters between users. Thus, for example, the users from the non-harnessed course 102 can have face-to-face encounters with users not only in the non-harnessed course 102, but also the harnessed course 104, and the zip-line section 106. Likewise, the users from the harnessed course 104 can have face-to-face encounters with users from not just the harnessed course 104, but also the non-harnessed course 102 and the zip-line section 106. Also, the users from the zip-line section 106 can have face-to-face encounters with not only the users from the zip-line section 106, but also the non-harnessed course 102, and the harnessed course 104. In addition, the wet play structure 100 as formed can include a high density of users in spaces designed to facilitate interaction using interactive units, such as water-toys, puzzles, or any other means of collaboration, competition, or other means of manipulating other user's immediate surroundings. This can encourage families to interact with each other to enjoy the wet play structure 100 while simultaneously tailoring the experience to suit each family member's thrill level thereby maximizing the experience for each family member on both a group and individual level.

In one embodiment, the non-harnessed course 102, the harnessed course 104, and the zip-line section 106 can form three different paths. However, users from each of the different paths can interact with each other. For example, users in the non-harnessed course 102 may be able to interact with users in the harnessed course 104, and the zip-line section 106, even though the users in the non-harnessed course 102 are not in the harnessed course 104 or the zip-line section 106. This can be advantageous for a group, such as a family with diverse thrill requirements because each of the members of the group can enter the non-harnessed course 102, the harnessed course 104, and the zip-line section 106 depending on their thrill preferences. In addition, the members of the group or family can traverse through the non-harnessed section 102, the harnessed section 104, and/or the zip-line section 106 simultaneously and even talk or interact with each other, regardless of whether they are in the same course/section. In one embodiment, the users can be within close proximity to each other, such as within a few feet, even if they are in different courses/sections.

Thus, the wet play structure 100 allows the groups to remain together when traversing the wet play structure 100. Therefore, instead of having only some or part of the members go through an attraction while the other members of the group wait due to the diverse thrill preferences of the members of the group, the wet play structure 100 allows all of the members of the group to traverse the wet play structure 100 at the same time and enjoy a joint experience. This can increase valuable time together with a group, which can be especially beneficial when the group is a family.

In one embodiment, the users can be in swimsuits or other suitable material when using the non-harnessed course 102, the harnessed course 104, and/or the zip-line section 106.

Referring to FIG. 1B, the non-harnessed course 102 can provide a low thrill level, but with a large capacity to allow for greater amount of user participation. While the harnessed course 104 includes a lower capacity, it can provide a higher thrill level. The zip-line section 106 can provide the highest thrill level, but at the lowest capacity. The mixture of thrill level and capacities will create greater interaction potential between users of the non-harnessed course 102, the harnessed course 104, and/or the zip-line section 106 as users can interact at their own comfort level.

Figure 2:
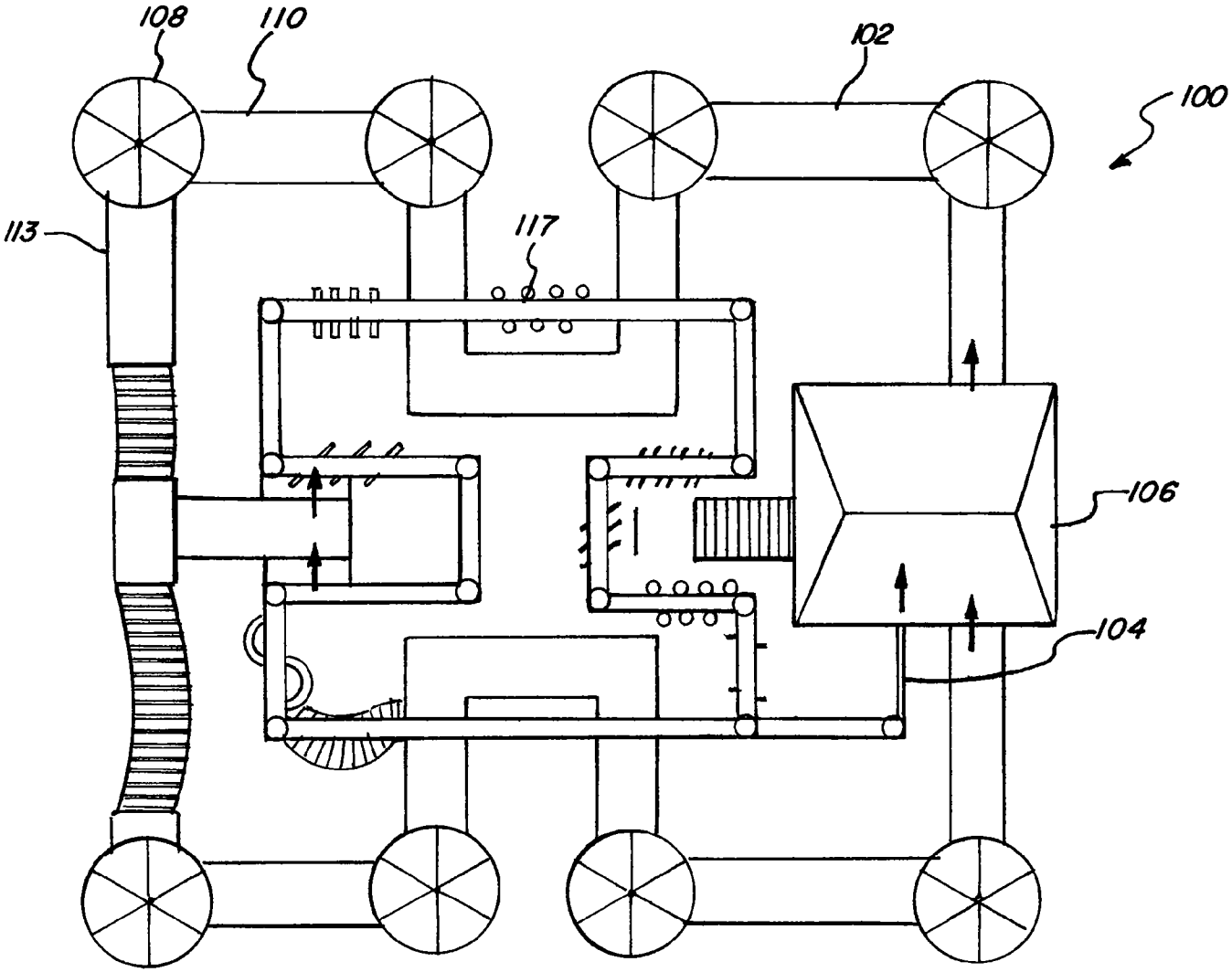
FIG. 2 is an overview of a wet play structure according to an embodiment of the present invention.

As seen in FIG. 2, the non-harnessed course 102 can include, for example, one or more towers 108, and one or more connection sections 110. The connection sections 110 can connect the towers 108 together. The towers 108 and connection sections 110 may constitute paths 113 a user may traverse to move from one part of the non-harnessed course 102 to another. In addition, the users traverse elevated paths 117 of the harness course 104 that are configured to allow the user to traverse the elevated path. The elevated paths 117 include obstacles a user crosses. Such obstacles are discussed throughout this application. Also, as shown in FIG. 3A, the harnessed course 104 can include a harness system 114 which guides the users in harnesses around the harnessed course 104 in a direction 116.

Figure 3B:
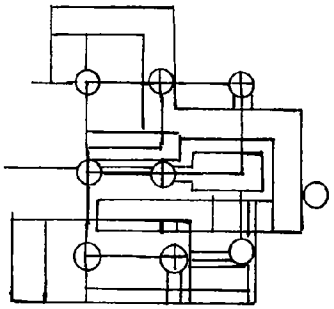
FIGS. 3A-3C are overviews of a wet play structure according to an embodiment of the present invention.
Figure 3A:
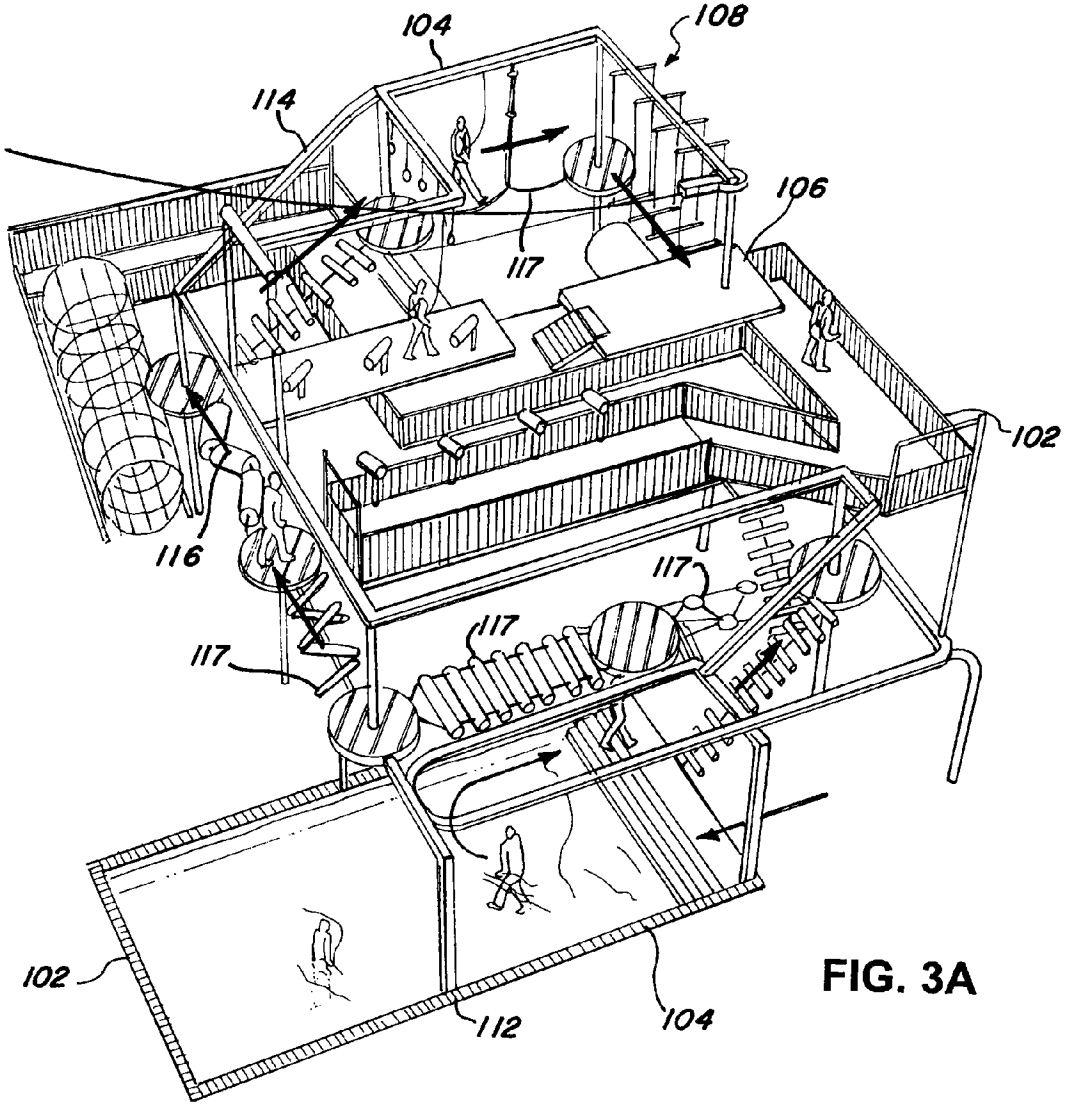
Figure 3C:
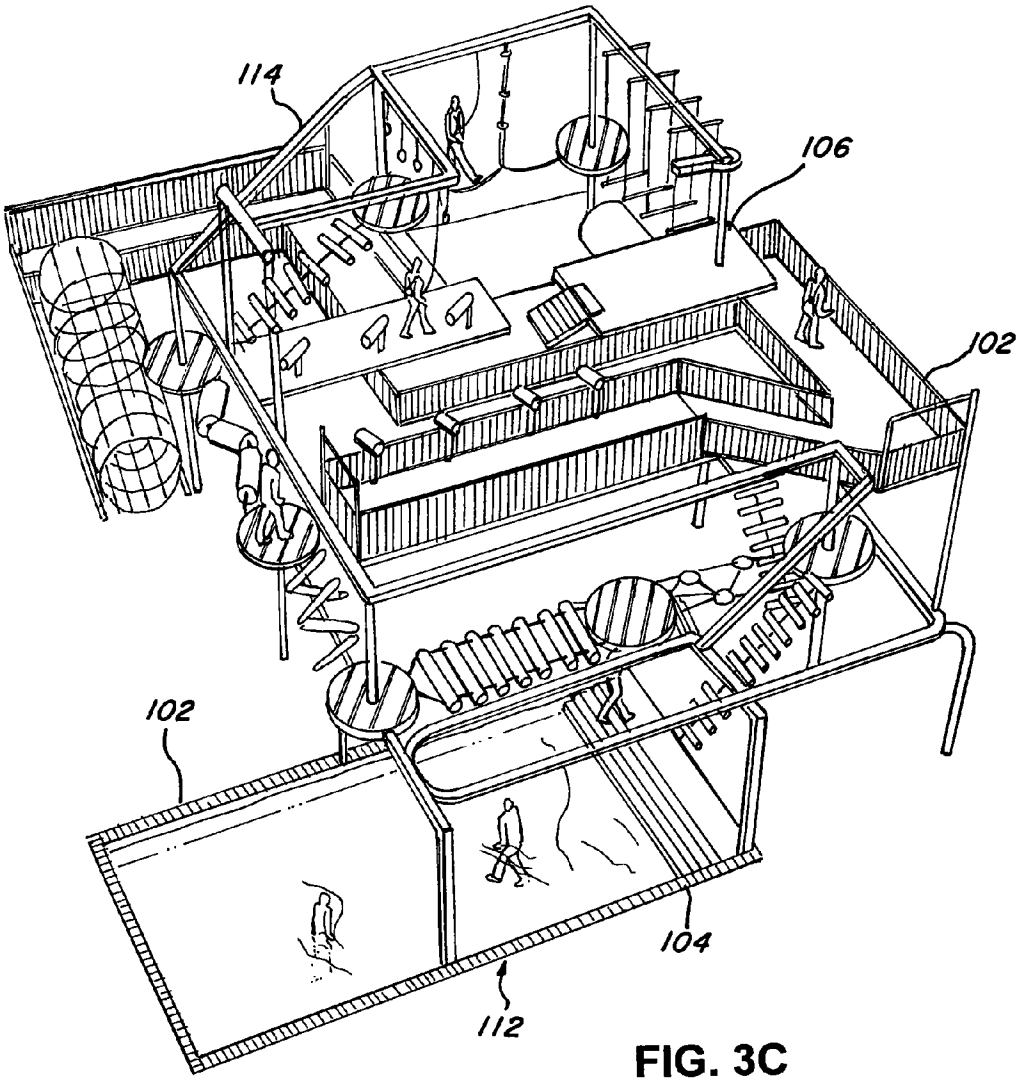
Figure 4:
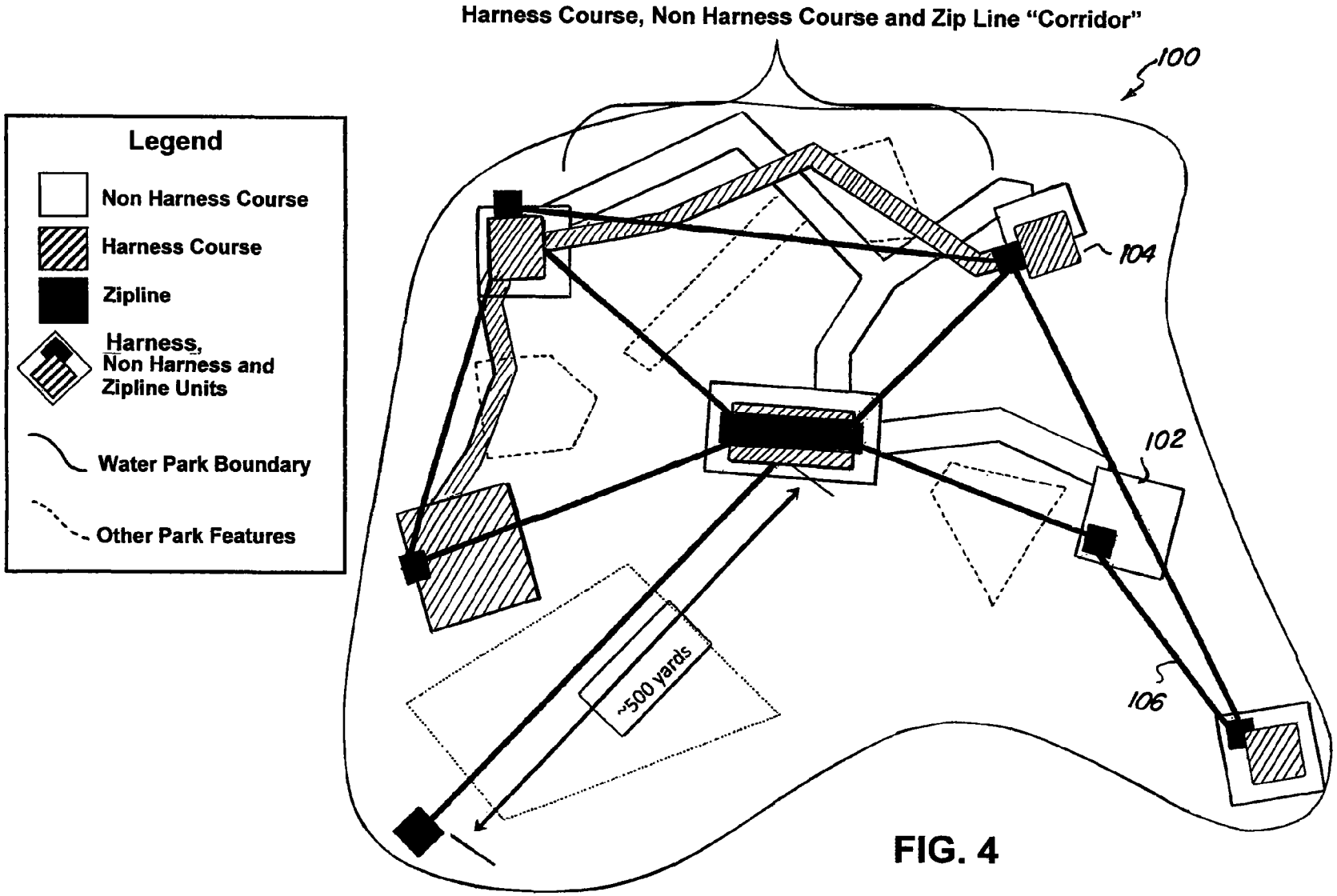
FIG. 4 is an overview of a wet play structure according to an embodiment of the present invention.

In addition, as shown in FIG. 3A and FIG. 3B, the wet play structure 100 can include features which are part of the non-harnessed course 102, the harnessed course 104, and/or the zip-line section 106. For example, the wet play structure 100 can include a pool 112, which can be part of both the non-harnessed course 102 and the harnessed course 104. Thus, although the non-harnessed course 102 can provide a lower thrill level, the users of the non-harnessed course 102 may be able to experience certain aspects of the harnessed course 104, and/or the zip-line section 106, such as through common areas. In addition, the users of the non-harnessed course 102 can still interact with other users of the harnessed course 104, and/or the zip-line section 106 such as by using interactive units which will be described below, or witnessing interactions of other users in the different courses/sections. The interactive units can also be common interactive units shared by various courses/sections. The interactive units may form fluid conduits configured to transmit water onto a user while the user traverses the elevated path 117. FIG. 4 depicts a layout of the wet play structure 100. As can be seen, the wet play structure 100 can exist as a standalone unit, or for connecting park attractions. Thus, the wet play structure can not only be an attraction, but can also be used as trails or pathways for users to access different park attractions. This can alleviate traffic in the park as users can now have multiple possibilities for going from one park attraction to another park attraction.

Figure 5A:
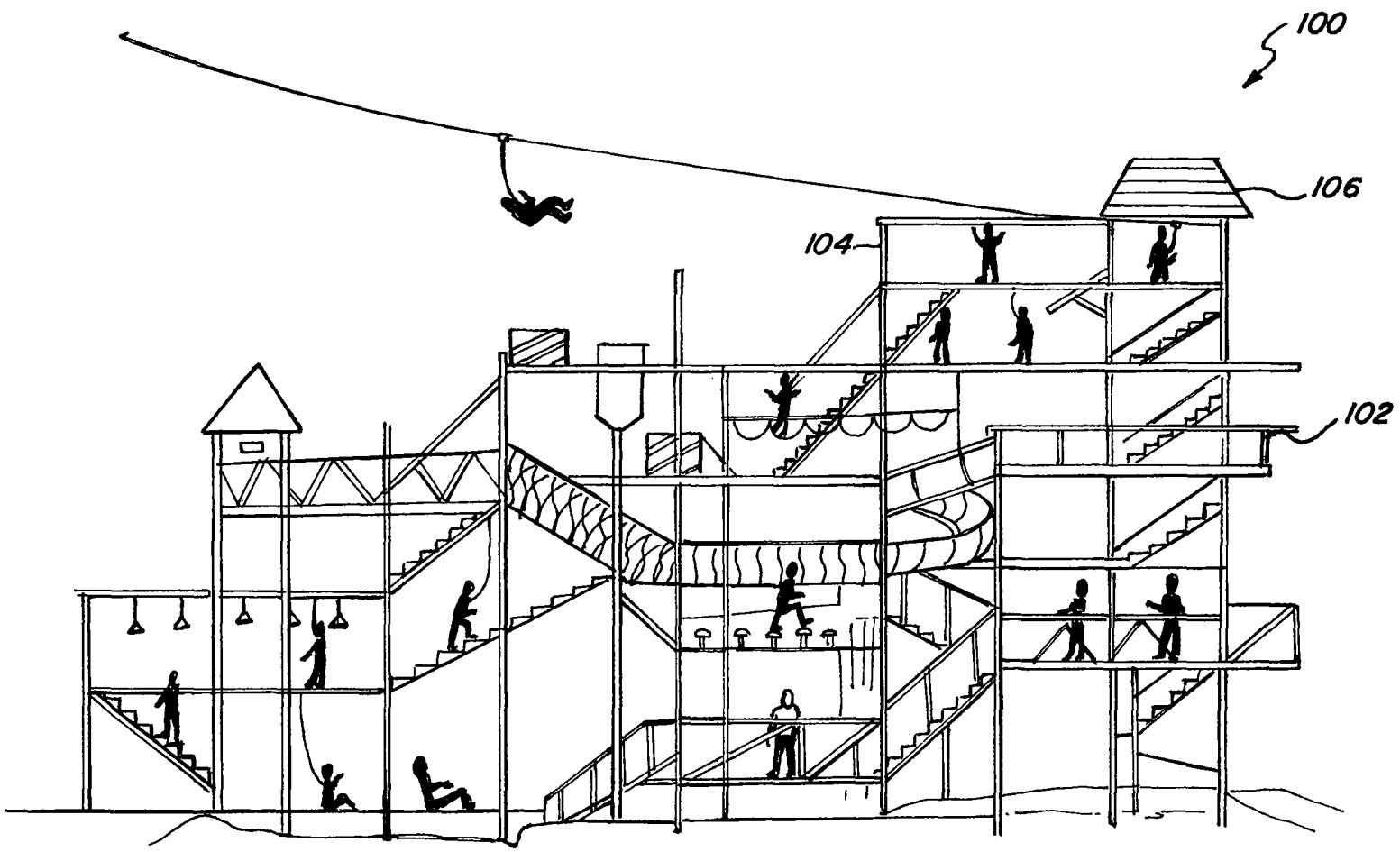
FIGS. 5A and 5B are overviews of a wet play structure according to an embodiment of the present invention.
Figure 5B:
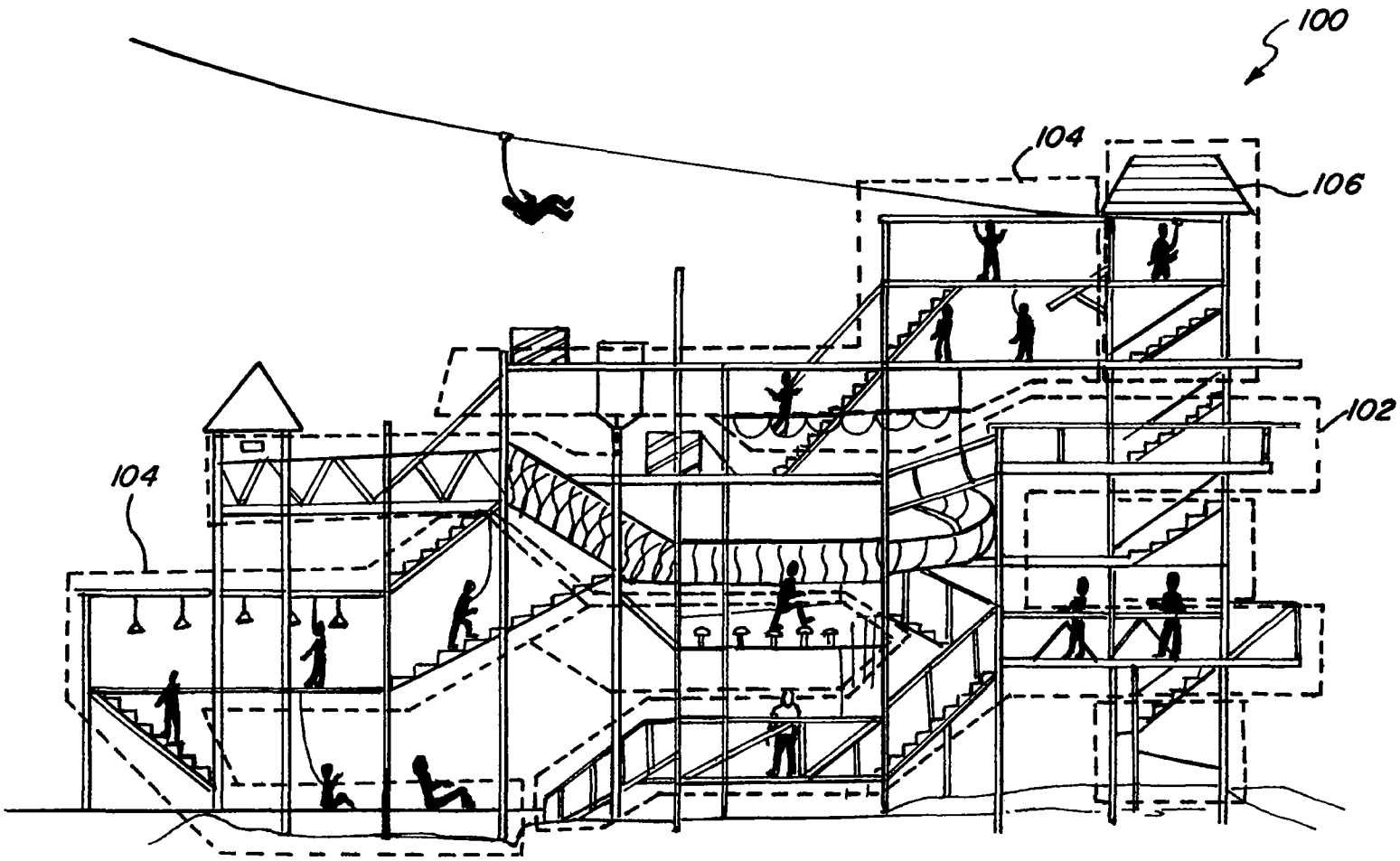

In addition, a side view of the wet play structure 100 can be seen in FIG. 5A, and FIG. 5B. As can be seen, the wet play structure 100 can be multi-level and can be a high elevation product. It can be designed to take advantage of the empty space above and between existing park attractions. The wet play structure 100 can increase, for example, the vertical participant density of the park in which the wet play structure 100 is implemented. As can be seen in FIG. 5B, the wet play structure 100 can be 40 feet or taller. The harnessed course 104 and non-harnessed course 102 may therefore include a plurality of paths 117, 113 respectively (as shown in FIG. 3A) positioned above each other.

Figure 6:
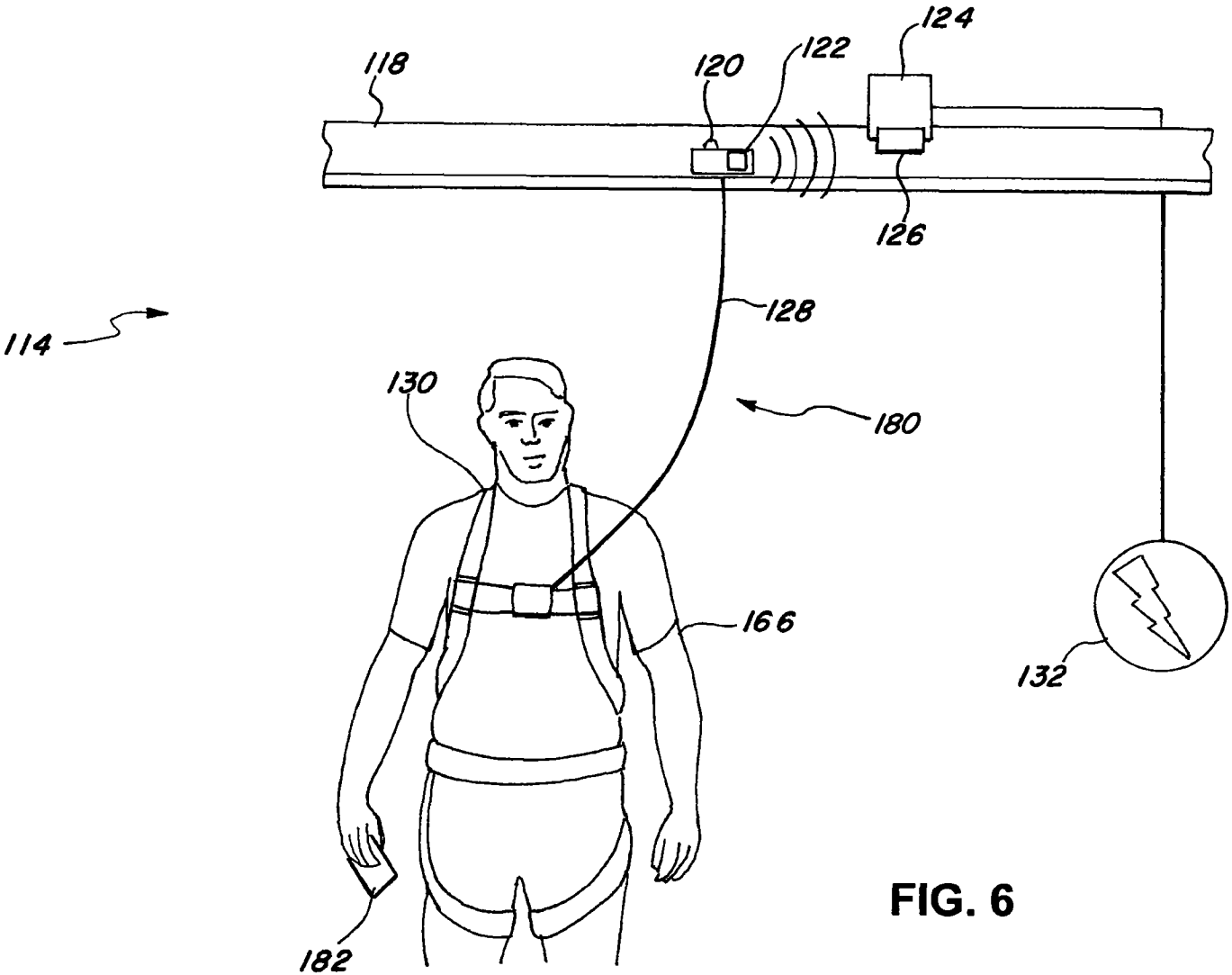
FIG. 6 depicts a harness system of a harnessed course according to an embodiment of the present invention.

The harness system 114 for the harnessed course 104 can be seen in FIG. 6. In one embodiment, the harness system 114 can include, for example, features of a harness system disclosed in Liggett, U.S. Pat. No. 7,416,054 entitled "CABLE HOOK TRACKING SYSTEM," which is hereby incorporated by reference in its entirety. In the harness system 114, a harness 130 is attached, or tethered, to a track 118 through a lanyard 128 and an attachment unit 120. The harness 130 can be, for example, swimsuit friendly. A user 166 can be secured to the harness 130 to permit movement of the user 166 at or near the track 118 depending on the length of the lanyard 128. The harness 130 can also support the user 166 and/or prevent the user from sustaining substantial impact with the ground or water if the user 166 slips or falls from an elevated path.

The attachment unit 120 is free to move around the track 118 to allow movement of the user 166. In one embodiment, the attachment unit 120 can be, for example, a puck. The attachment unit 120 can also include a radio-frequency identification ("RFID") system 180. The RFID system 180 can include a RFID unit 122 integrated into the attachment unit 120. The RFID system 180 can also include a RFID reader 124, and a RFID unit 126 integrated into the track 118. In one embodiment, the RFID unit 122 can be located on the harness 130 and/or be integrated into an object the user would wear or carry such as a bracelet, card, or fob. The RFID reader 124 can also be integrated into various interactive units instead of just the track 118. In one embodiment, the RFID system 180 can be a swipe-plate set-up. Although the RFID unit 122 and/or the RFID system 180 is described as being used for the harnessed course 104, it is understood that the RFID unit 122 and/or the RFID system 180 can also be used in the non-harnessed course 102, and/or the zip-line section 106.

The RFID reader 124, the RFID unit 126, and the RFID unit 122 can cooperate to determine a location of the user 166, for example, through determining the location of the attachment unit 120. The RFID system 180 can also interface with other features such as interactive features to allow a customized experience for the user 166. For example, when the RFID reader 124 detects that the attachment unit 120 is nearby, an event 132 can be triggered. The event 132 can be, for example, the activation of interactive units which can spray the user with water or other objects, various visual elements, various sounds, and/or various objects. The event 132 can also be, for example, events which the user cannot see such as the addition of points, the identification of the user's location, and/or the recordation of information.

In one embodiment, the user can possess a customer card, which can include customer information such as the user's dollar balance, statistics, and preferences. A portion or all of the information can be loaded onto the RFID unit 122 to enable a customized experience for the user. For example, if the user wishes to have a more thrilling adventure, the interactive units in the form of fluid conduits can spray more water or at a higher velocity towards the user. Thus, the user may be sprayed with water in response to the RFID unit 122 being activated. However, if the user wishes to have a more comfortable adventure, the interactive units can spray less water or at a lower velocity towards the user. In addition, the RFID unit 122 may be able to communicate with the interactive units and also allow the user to earn points, for example, through games in the harnessed course 104. The points can later be exchanged for rewards. In addition, the RFID unit 122 can be used to calculate information such as the number of times the user has entered the harnessed course 104, or the statistics of the user performance during the harnessed course 104. Such information can later be displayed as a printout for the user's enjoyment. In addition, the RFID unit 122 can be used a part of a loyalty program, or to track or monitor customer metrics, performance, habits, and/or history.

In operation, the user can enter the harnessed section 104, and under the guidance of an operator, secure the harness 130 to himself. The user or the operator can then enter a designated entrance area in the harnessed section 104 and secure the lanyard 128 to the track 118. The user can then proceed through the harnessed section 104 within a controlled time frame and exit at a designated exit area. The movements of the user can be monitored using the RFID unit 122, the RFID reader 124, and/or the RFID unit 126. The user can then exit through a designated exit area, and remove the harness 130. Prior to exiting the designated exit area, the user can also, for example, utilize the zip-line section 106. In one embodiment, the user does not have to remove the harness 130 before utilizing the zip-line section 106. In one embodiment, the harnessed section 104 can be foot and hand friendly including foot and hand friendly elements to avoid the need for footwear. In another embodiment, footwear can be provided to users.

In one embodiment, the track 118 can be motorized. The motorization of the track 118 can allow the user to be gently towed along the track 118, such as if the user is stuck or frozen along, for example, an elevated path. The motorization of the track 118 can also be used to move the user when the RFID unit 122, the RFID reader 124, and/or the RFID unit 126 indicate that it is safe to move the user and that the user is in a position to be moved. The movement of the track 118 can also be done to ensure hourly throughput by preventing users from remaining too long in the wet play structure on one or more courses or sections thereof.

Figure 7:
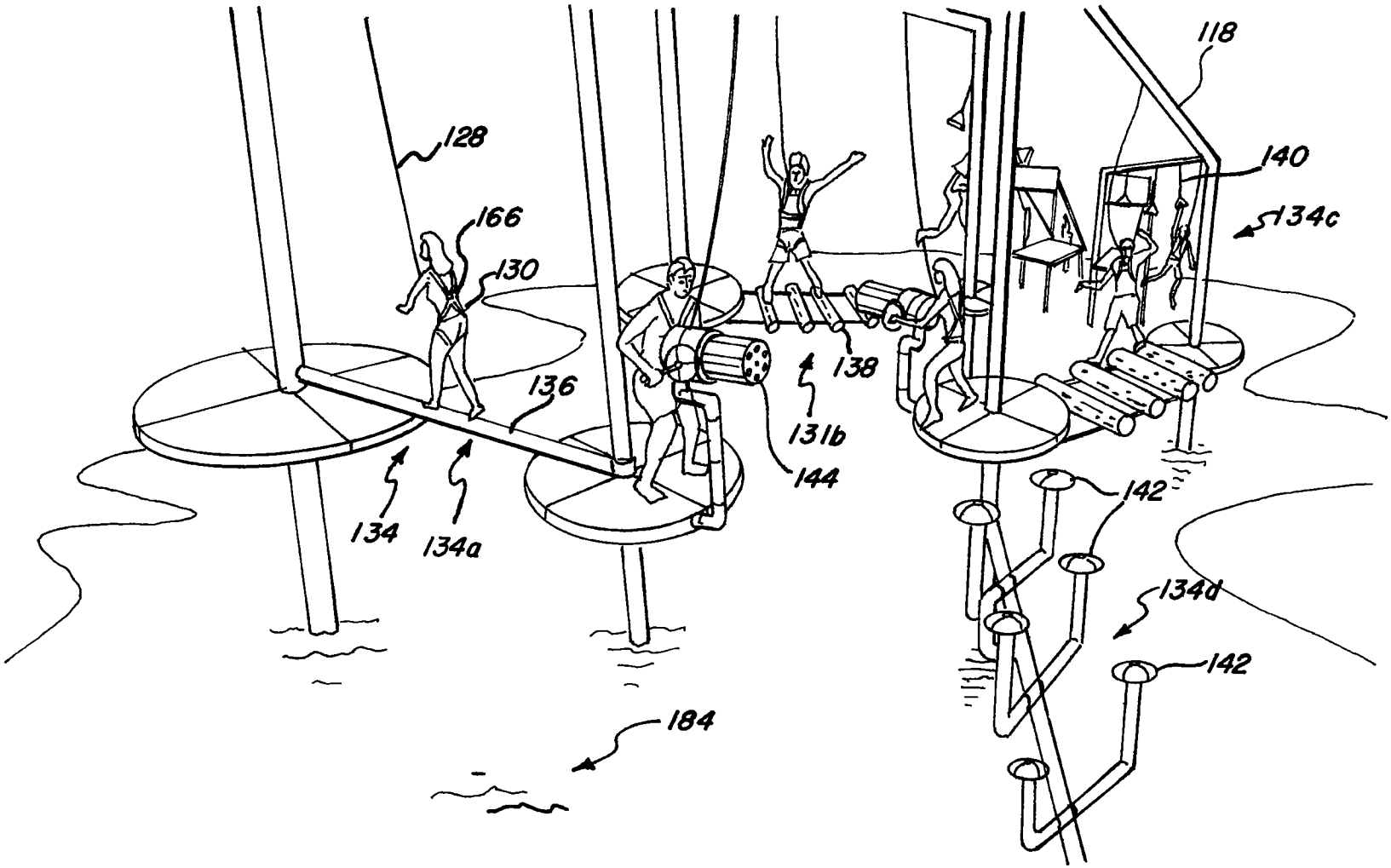
FIG. 7 depicts a harnessed course section of the wet play structure according to an embodiment of the present invention.

In FIG. 7, the users 166 can be attached to the track 118 using the lanyard 128 and can be free to move around the track 118 in the harnessed course 104. As can be seen in FIG. 7, the harnessed course 104 can include obstacle courses 134 over a pool 184. The obstacle courses 134 provide elevated paths configured to allow the users 166 to traverse the elevated path. The pool 184 is configured to contain water. The obstacle courses can be challenging courses which require deft balance and which can be extremely challenging without the harness system 114 (FIG. 6). However, due to the harness system 114, the user can attempt the obstacle courses 134 with little chance of bodily harm. In one embodiment, the obstacle courses 134 can have a varying configuration and varying levels of challenge to allow for a constantly varying experience. Such experiences can be varied, for example, based on the preferences loaded in the RFID unit 122. In another embodiment, the configuration and varying levels of challenge presented by the obstacle courses 134 can be chosen by the user at the time of encounter of the obstacle courses 134. In addition, the obstacle course 134 can form various paths with the path that the user traverses being selected for the user based on the preferences loaded onto the RFID unit 122, or by the user at the time of encounter with the obstacle courses 134.

In one embodiment, the harnessed course 104 can include, for example, interactive units such as the fluid conduit 144. Using the fluid conduit 144, the user can interact with other users by spraying water on the other user. The fluid conduits are devices that transfer water to be transmitted to the user. The water may be delivered to the fluid conduit from a local source (e.g., a user loads water into the fluid conduit) or a centralized source (e.g., a centralized pumping system). Thus, the fluid conduit 144 can be, for example, a water interactive unit. The water interactive unit can be, for example, a water shooting device or cannon that shoots water. In one embodiment, the pressure of the water sprayed be varied, for example, based on user preferences loaded onto the RFID unit 122 by the user spraying the water, or the user in which water will be sprayed upon. In another embodiment, the user spraying the water can select the pressure of the water that is sprayed by the fluid conduit 144 at the time the user encounters the fluid conduit 144. In yet another embodiment, access to the fluid conduit 144 can be allowed or disallowed based on information supplied by the RFID unit 122. The information supplied by the RFID unit 122 can correspond, for example, to the information supplied by the user, such as the age of the user, any rewards points, level of comfort with the wet play structure 100, and/or any other relevant information. Although the harnessed course 104 includes the fluid conduit 144, the harnessed course can also include a fluid conduit 146 as shown in FIGS. 8A-E.

In addition, the fluid conduits 144 and 146 can be located in the non-harnessed course 102 as well to allow more users to interact with each other. Thus, users in the non-harnessed course 102 can interact with users in the non-harnessed course 102, the harnessed course 104, and/or the zip-line section 106 using the fluid conduits 144 and/or 146. Regardless of the placement of the fluid conduits 144 and/or 146, users from all of the courses/sections may be able to view the various interactions of other users such as the spraying of water by the fluid conduit 144 onto other users.

Figure 8B:
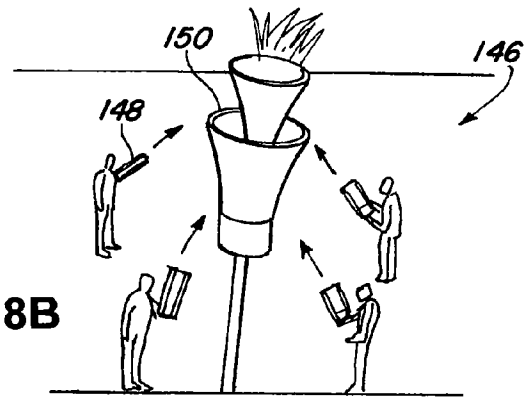
FIG. 8A-E depict fluid conduits in the form of interactive units according to an embodiment of the present invention.
Figure 8E:
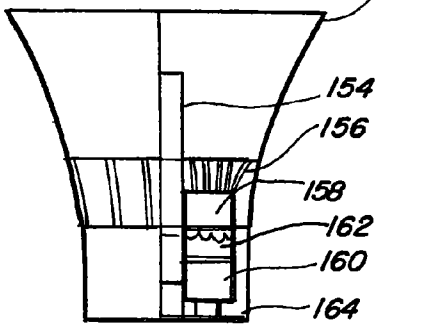
Figure 8C:
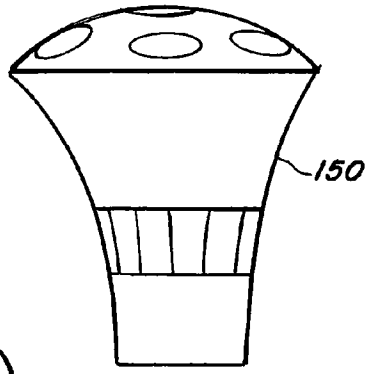
Figure 8A:
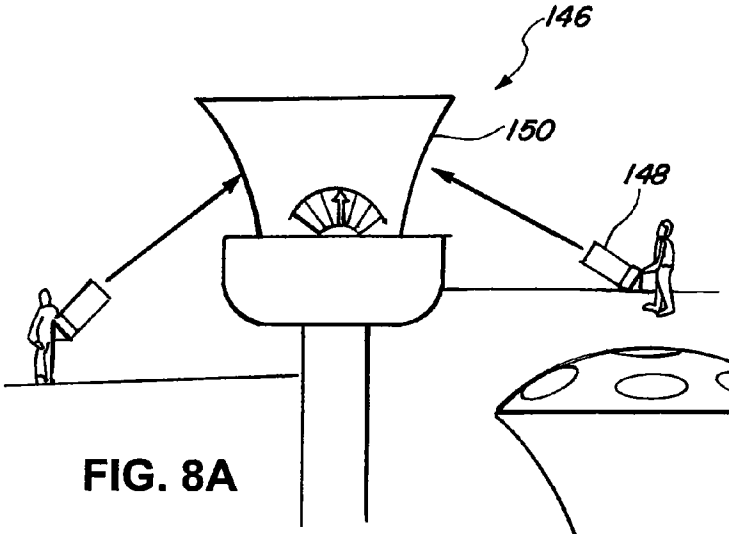
Figure 8D:
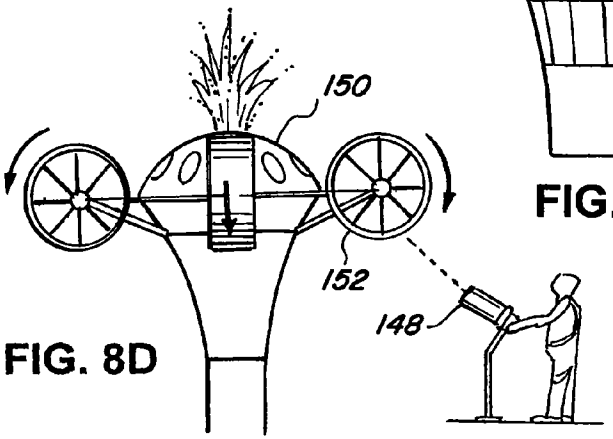

In FIGS. 8A-E, the fluid conduit 146 can include a cannon 148 and/or a water dispersion unit 150. The user can use the cannon 148 to shoot water onto the water dispersion unit 150. Once the water dispersion unit 150 has accumulated enough water, the water dispersion unit 150 can erupt and spray water over the users in the general area, including the users who were not using the cannon 148. In one embodiment, as shown in FIG. 8D, the water dispersion unit 150 can include a water wheel 152. When the canon 148 shoots water onto the water wheel 152, the water wheel 152 rotates, which triggers the water dispersion unit 150 to erupt and spray water over the users in the general area.

In one embodiment, as shown in FIG. 8E, the water dispersion unit 150 can include a high pressure nozzle 154, slats 156, a geyser unit 158, and a reservoir 164. The reservoir 164 can store water 160. Once the water 160 reaches, for example, a predetermined level 162, it can be erupted through the slats 156 using the geyser unit 158. In one embodiment, the fluid conduits 146 need not be located strictly in the harnessed course 104, but can also be located in the non-harnessed course 102. In addition, the fluid conduits 146 can be used to interact with users of the zip-line section 106.

Referring back to FIG. 7, the obstacle courses 134 can include an obstacle course 134*a*, an obstacle course 134*b*, an obstacle course 134*c*, and/or an obstacle course 134*d*. Each obstacle course 134*a-d* forms an elevated path a user may traverse. If the user loses his balance in any of the obstacle courses 134, he is supported by the harness 130, which is attached to the track 118 using the lanyard 128 and the puck 120 (FIG. 6). The user may fall a few inches, and may have some or parts of his body immersed in water, but his falling motion will generally be prevented or stopped by track 118 connected to the harness 130 and the lanyard 128. The user can grasp the lanyard 128 to regain his balance and/or footing. In addition, the obstacle courses 134 can also include optional designated beams or foot steps to aid the user in regaining his balance and/or footing.

The obstacle course 134*a* can include obstacles, for example, a thin rail 136 which the user can cross by maintaining his balance on the thin rail 136. The obstacle course 134*b* can include a bridge 138, which the user can cross by maintaining his balance on each of the thin planks that form the bridge 138. The bridge 138 may be movable, and may move in response to the movement of the user. The obstacle course 134*c* can include swinging monkey bars 140. The user can cross through the swinging monkey bars 140 by gripping, dangling and swinging through the swinging monkey bars 140.

Figure 9A:
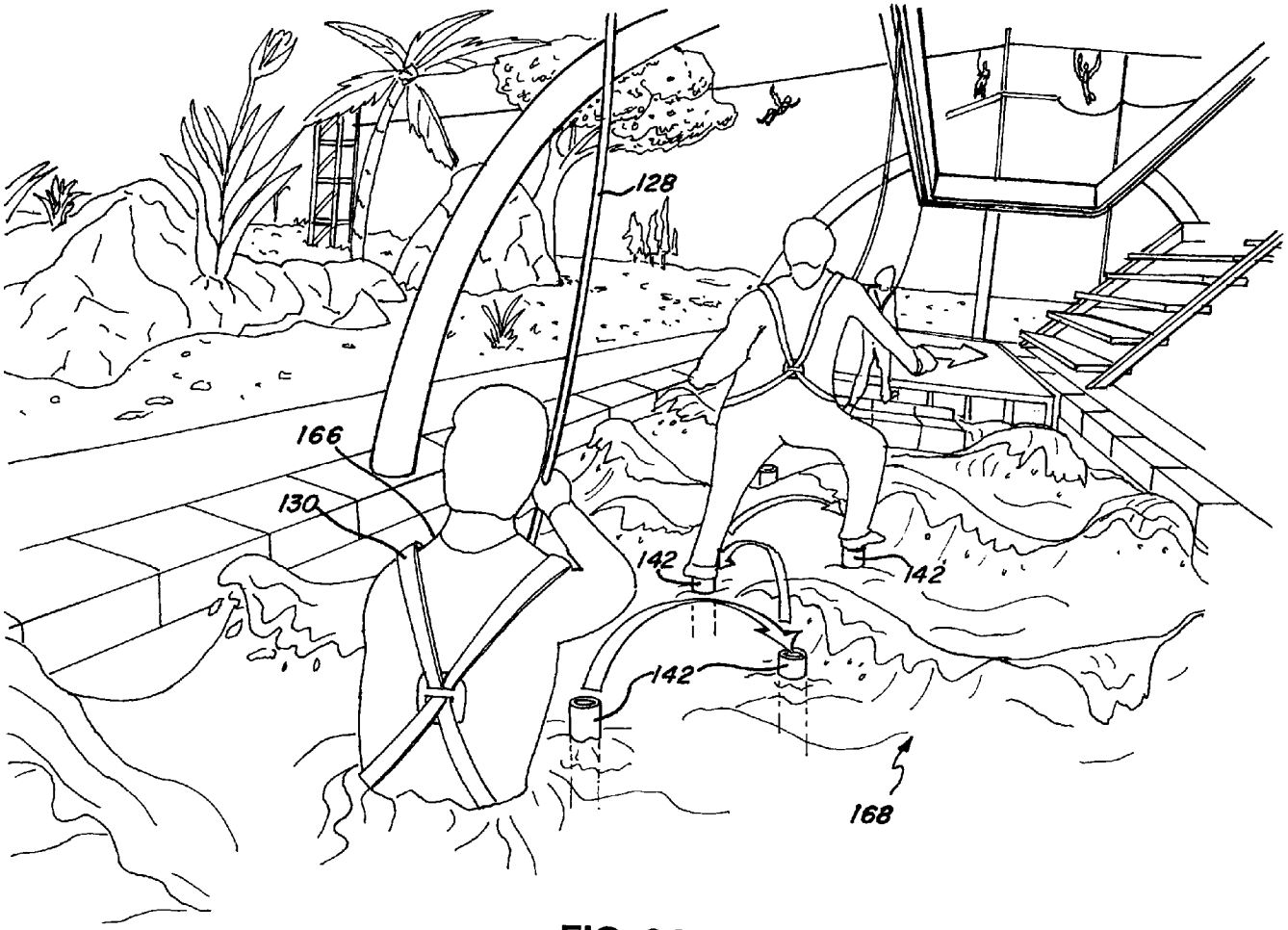
FIGS. 9A and 9B depict a harnessed course section of the wet play structure according to an embodiment of the present invention.
Figure 9B:
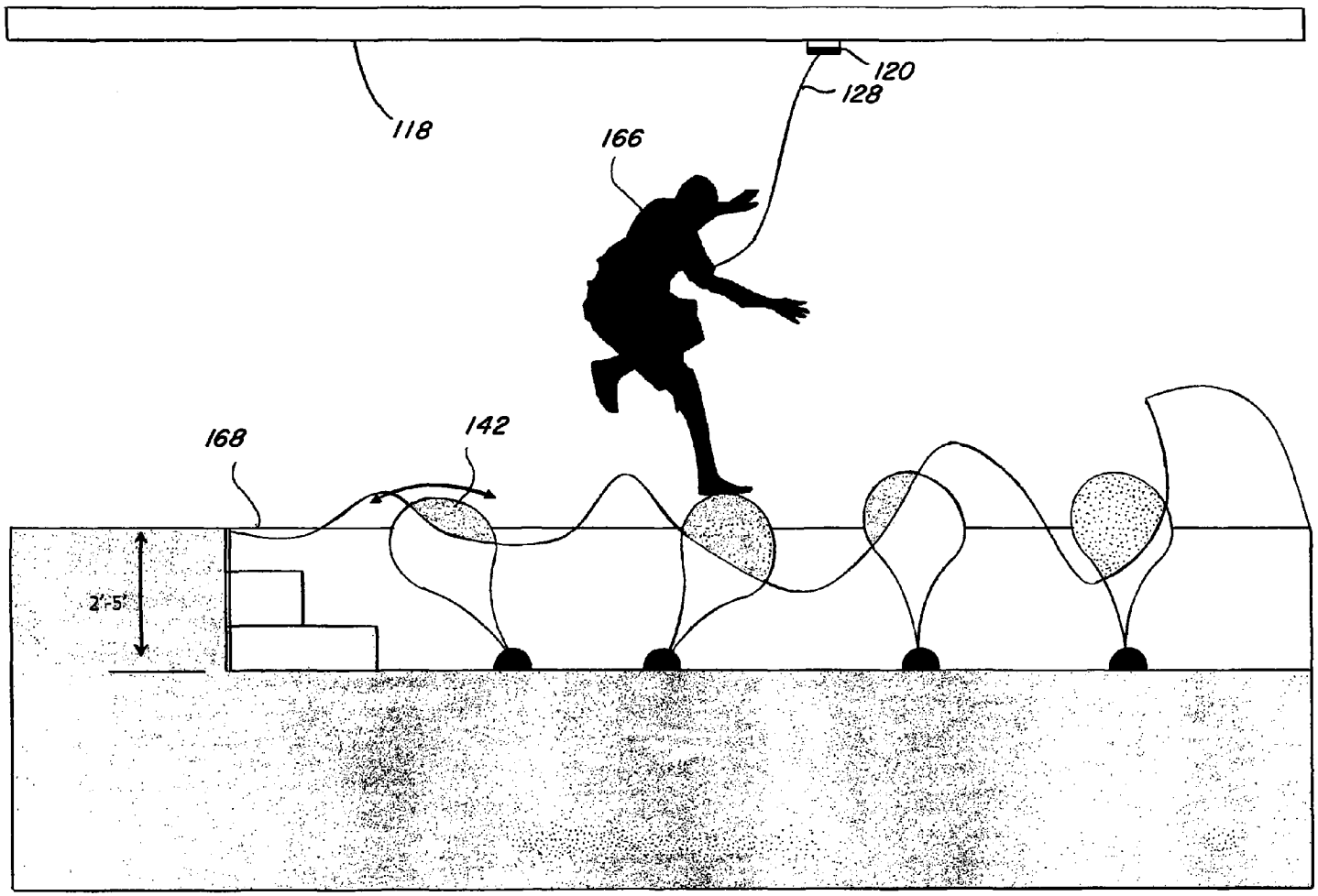

The obstacle course 134*d* can include pods 142, which require the user to deftly balance himself as he walks through the pods 142. The obstacle course 134*d* can also be seen, for example, in FIGS. 9A and 9B. As seen in FIGS. 9A and 9B, the user 166 is attached to the track 118 through the lanyard 128 and the puck 120. The user 166 is free to move around the track 118. The user 166 crosses through the pods 142 using his balance. If the user 100 falls, he will contact the water 168 contained in the pool below. The pods 142 can be of any size or shape and can provide various amounts of surface which can be gripped by a foot of the user. In addition, the pods 142 can be stationary or mobile. In one embodiment, the pods 142 may include fluid conduits capable of propelling water upward to transmit water onto the user. In one embodiment, the pods 142 can be, for example, track elements. As can be seen in FIG. 9B, the track elements move in response to pressure supplied by the user 166. Also, waves can be splashed onto the user, and/or obscure the pods 142. Thus, the waves can impede progress of the user, and/or even knock the user off the pods 142.

Figure 10:
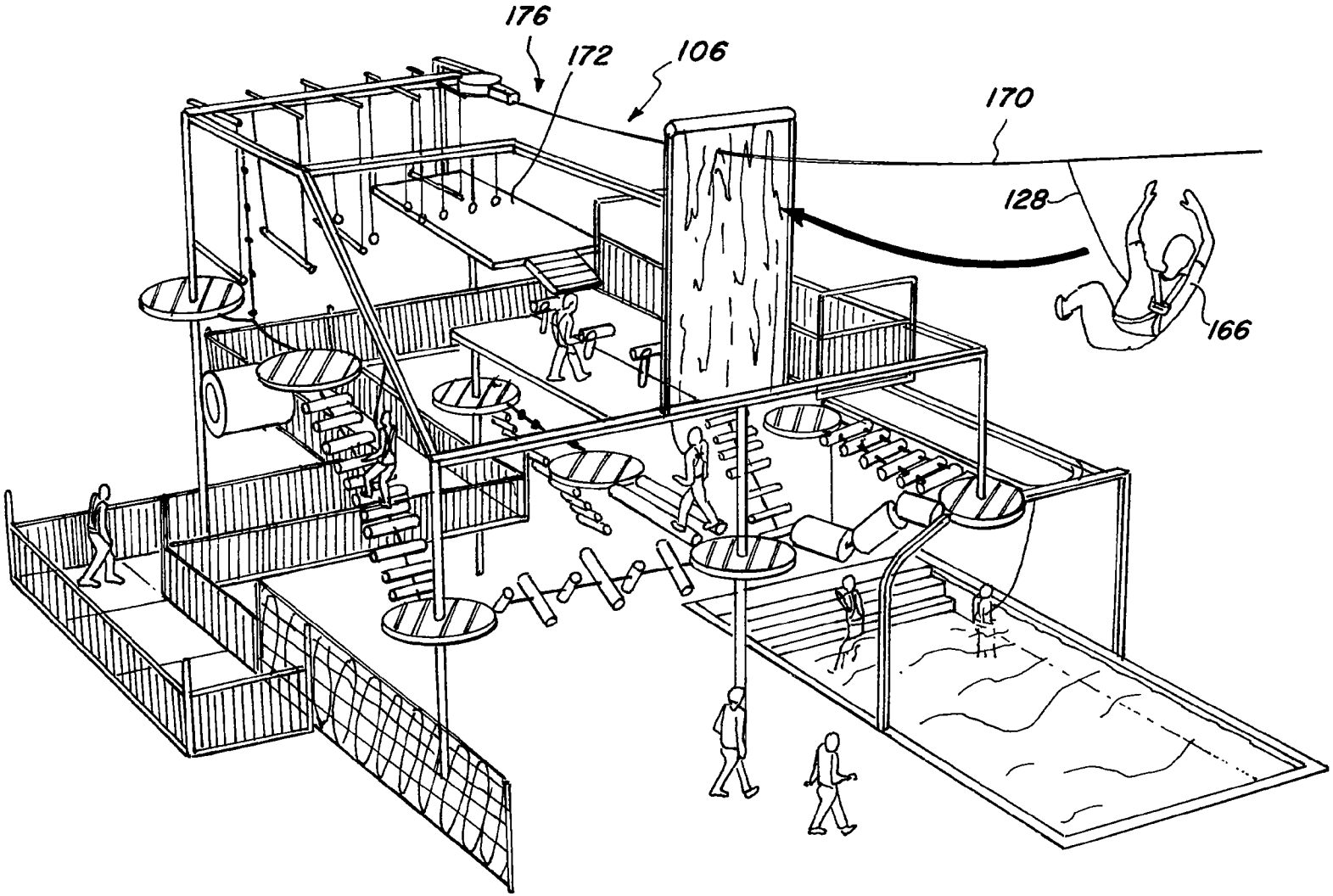
FIG. 10 depicts a zip-line section of the wet play structure according to an embodiment of the present invention.
Figure 11:
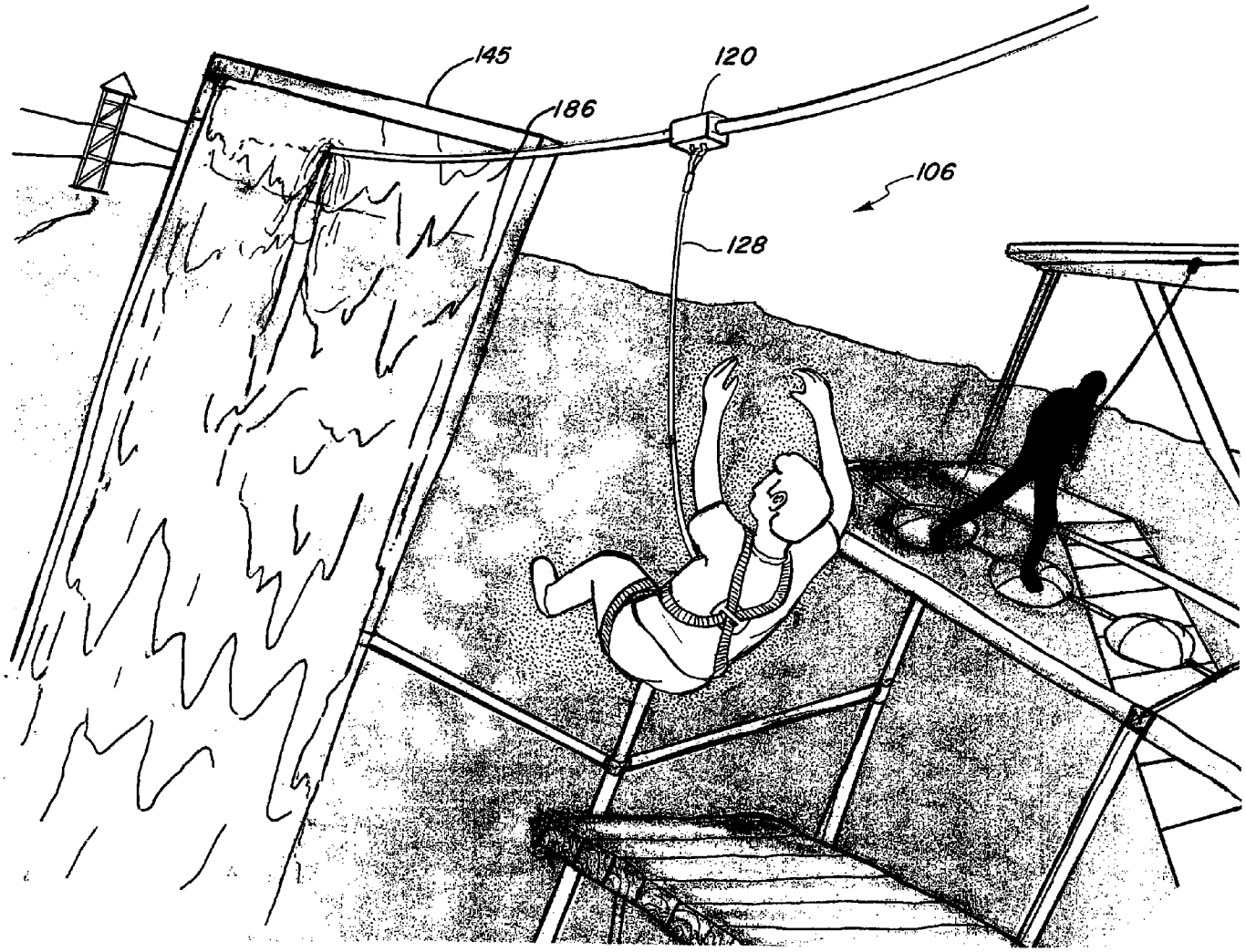
FIG. 11 depicts a zip-line section of the wet play structure according to an embodiment of the present invention.

The zip-line section 106 can be seen in FIG. 10 and FIG. 11. The zip-line section 106 can include zip-line 170, and a landing section 172 in an end zone 176. Thus, the user 166 is secured to the zip-line 170 using the harness 130 (FIG. 6), the lanyard 128, and/or the puck 120 (FIG. 6). In one embodiment, the harness 130, the lanyard 128, and the puck 120 are the same as those used in the harnessed course 104. In another embodiment, the user can enter the zip-line section 106 without accessing the harnessed course 104. In such an embodiment, the user can put on the harness 130 at that time.

The user 166 can travel on the zip-line section 106 on the zip-line 170 and land in the landing section 172 of the end zone 176. In one embodiment, the zip-line section 106 can traverse a wall of water 186, or waterfall, formed by a fluid conduit 145, as seen in FIG. 11. Thus, the user will be doused with water as he travels through the zip-line 170 and the wall of water 186. Optionally objects can be activated based on the RFID unit 120 to swing by the user or appear adjacent near the user without actually making contact with the user in order to increase the thrill provided by the zip-line section 106. In one embodiment, portions of the zip-line 170 can be in a horizontal or at an incline. In another embodiment, portions of the zip-line 170 can be motorized, such as to elevate the user up an incline before transitioning into a declining portion to increase the thrill and challenge of the zip-line section 106.

Figure 12:
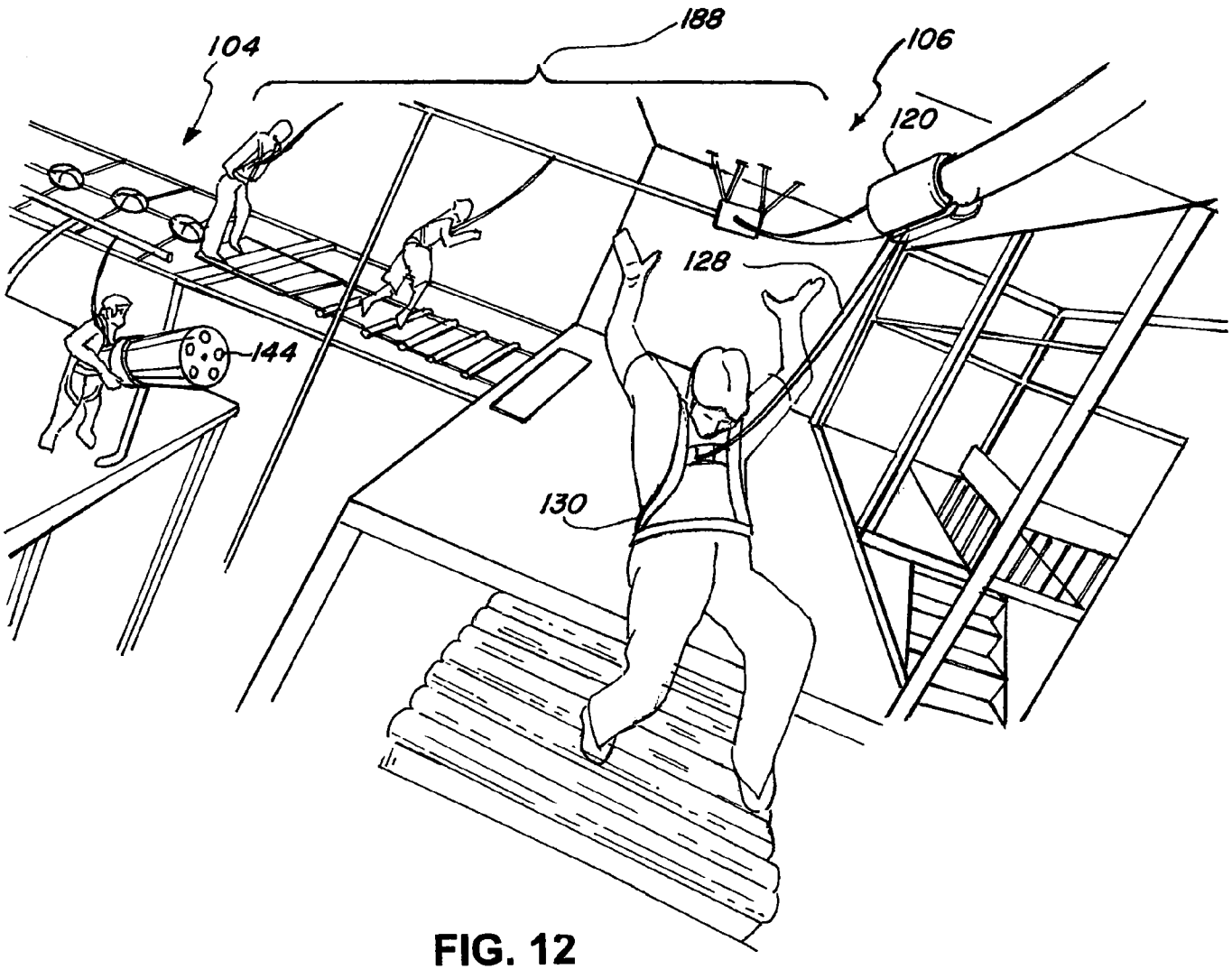
FIG. 12 depicts a transition section between a harnessed course section and a zip-line section of the wet play structure according to an embodiment of the present invention.
Figure 13:
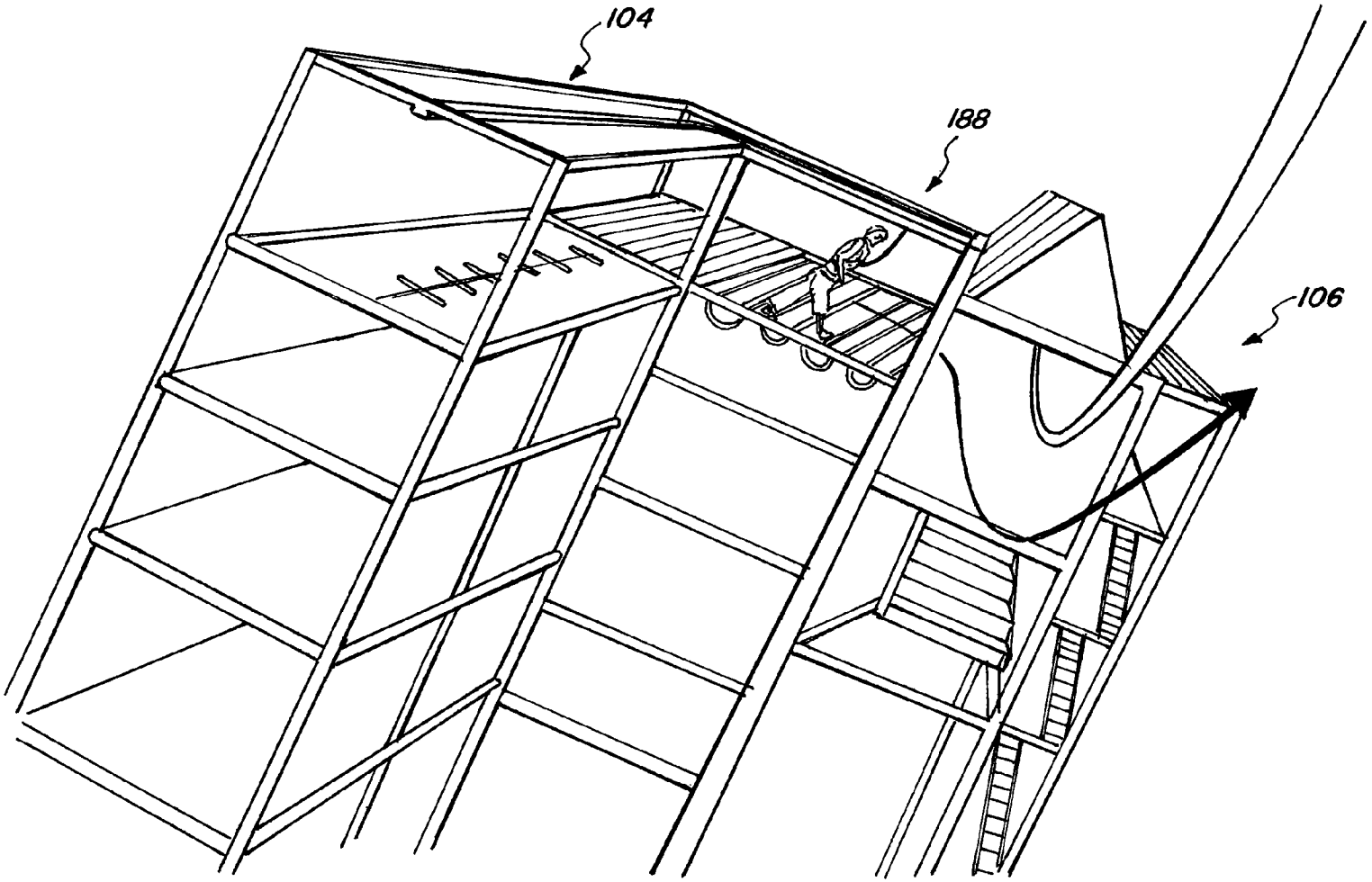
FIG. 13 depicts a transition section between a harnessed course section and a zip-line section of the wet play structure according to an embodiment of the present invention.
Figure 14:
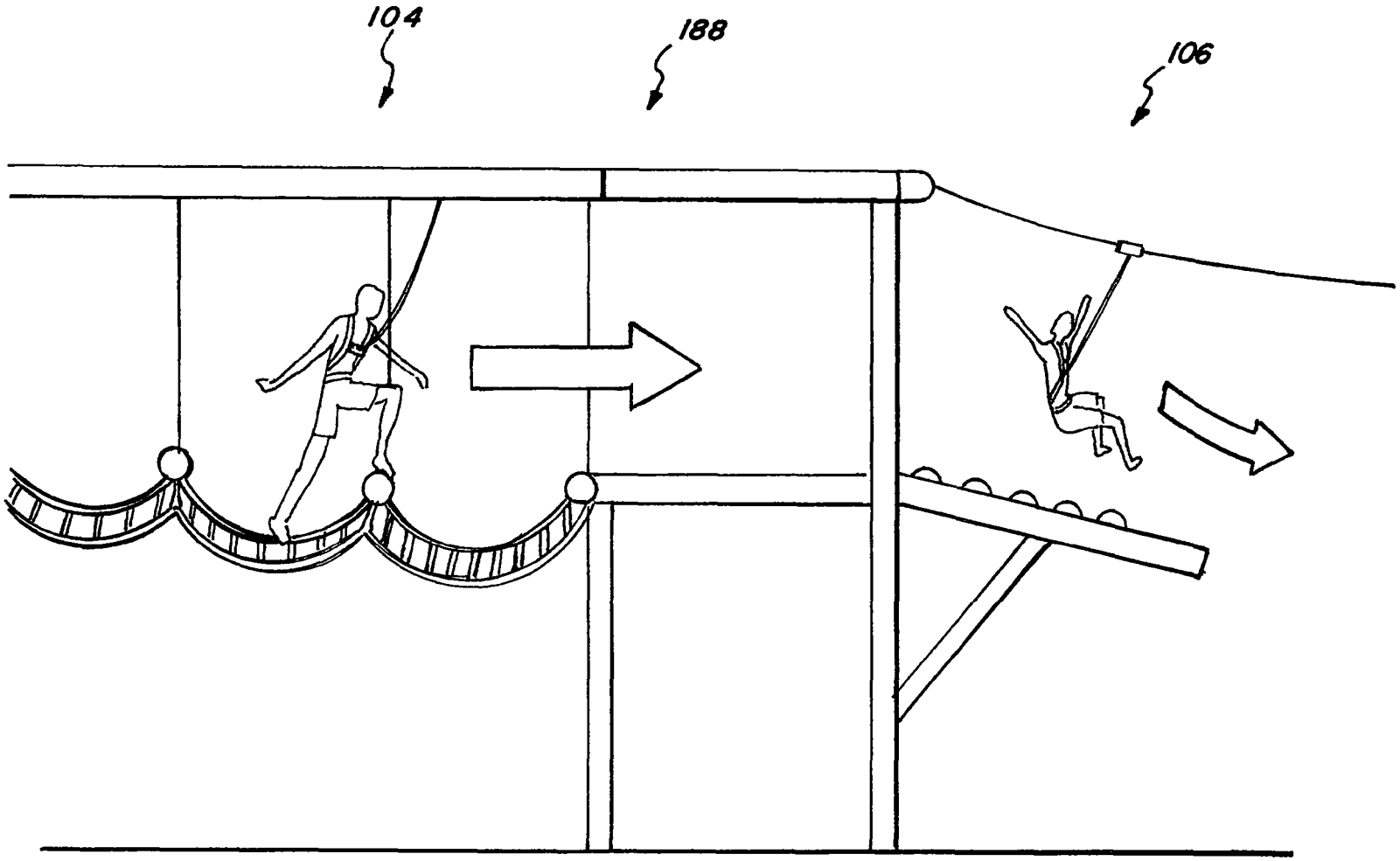
FIG. 14 depicts a transition section between a harnessed course section and a zip-line section of the wet play structure according to an embodiment of the present invention.

In one embodiment, as seen in FIG. 12, FIG. 13, and FIG. 14, a transition zone 188 can be employed to join the harnessed course 104 and the zip-line section 106. In the transition zone 188, a user can go from the harnessed course 104 to the zip-line section 106 without removing the harness 130, the lanyard 128, and/or the puck 120. This can allow the user to easily traverse between the harnessed course 104 and the zip-line section 106 without removing the harness 130, thereby improving the user's experience and the capacity of the harnessed course 104 and/or the zip-line section 106. In one embodiment, as seen in FIG. 12, the fluid conduit 144 for a user in the harnessed course 104 can be used to spray water onto a user in the zip-line section 106.

Figure 15:
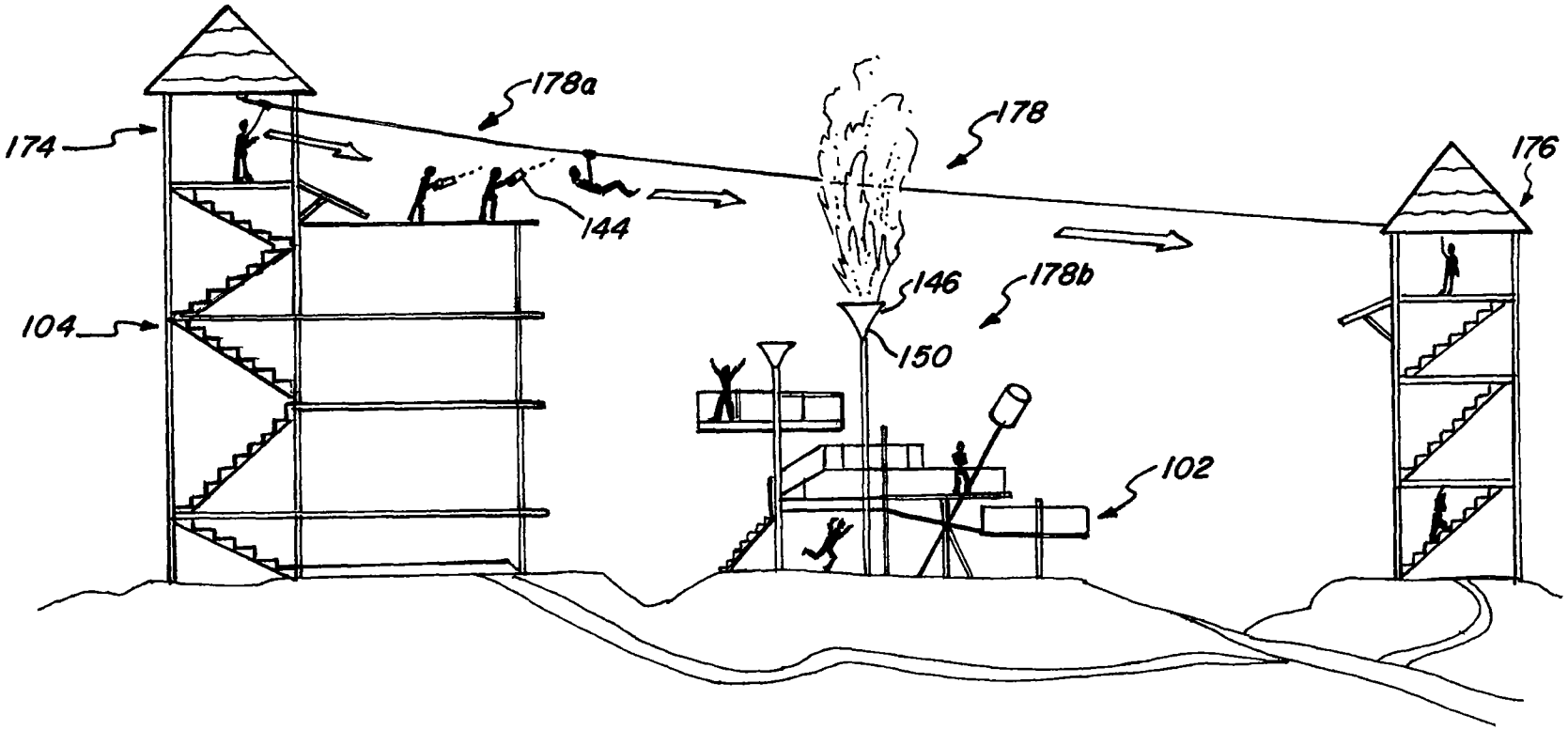
FIG. 15 depicts a zip-line section and interactive units according to an embodiment of the present invention.
Figure 16:
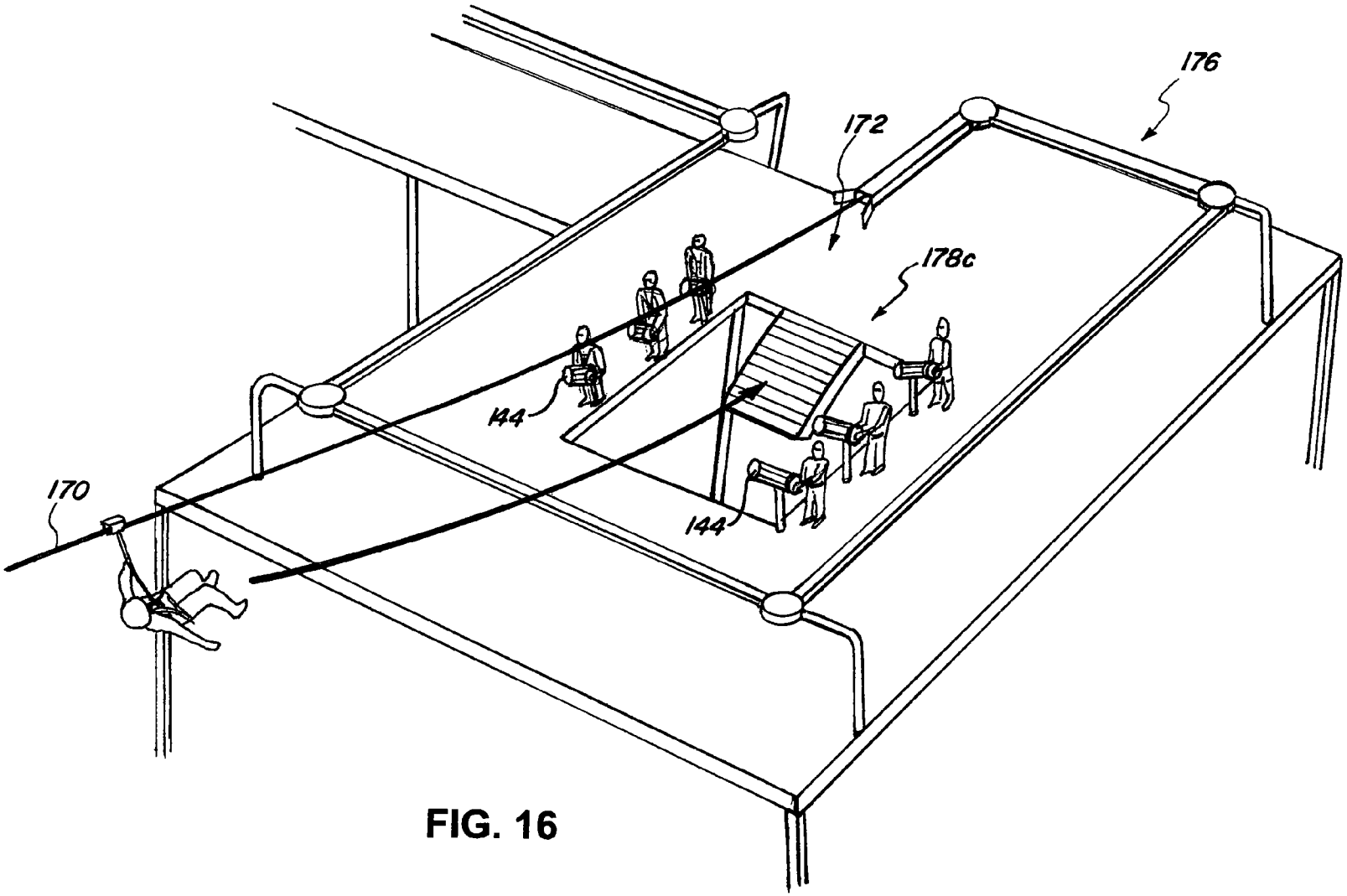
FIG. 16 depicts a zip-line section and fluid conduits in the form of interactive units according to an embodiment of the present invention.

As seen in FIGS. 15 and 16, the zip-line section 106 can include a start zone 174, an end zone 176, and/or fluid conduit zones 178, such as fluid conduit zones 178*a-c*. The fluid conduit zones 178*a-c* may be interactive zones. The fluid conduit zones 178*a-c* can include, for example, the fluid conduit 144, which can be used to spray water onto the user as he is traversing the zip-line 170. In one embodiment, the fluid conduit 178*b* includes the fluid conduit 146 as seen in FIG. 15 (and as described in FIGS. 8A-E). The water dispersion unit 150 can erupt water onto the zip-line 170 and the user traversing down the zip-line 170. The water dispersion unit 150 can be located in the non-harnessed course 102. In one embodiment, instead of being activated by the users of the fluid conduits 146, the water dispersion unit 150 is activated by the RFID unit 122 in the puck 120 (FIG. 6). The water dispersion unit 150 can be activated to erupt at a time prior to the user actually traversing over the water dispersion unit 150 so as to erupt at a safe distance from the user. As seen in FIG. 16, the fluid conduit zone 178*c* includes the fluid conduits 144 which can be used to spray water onto the user as he is traversing through the zip-line 170 onto the landing section 172 in the end zone 176.

Figure 17A:
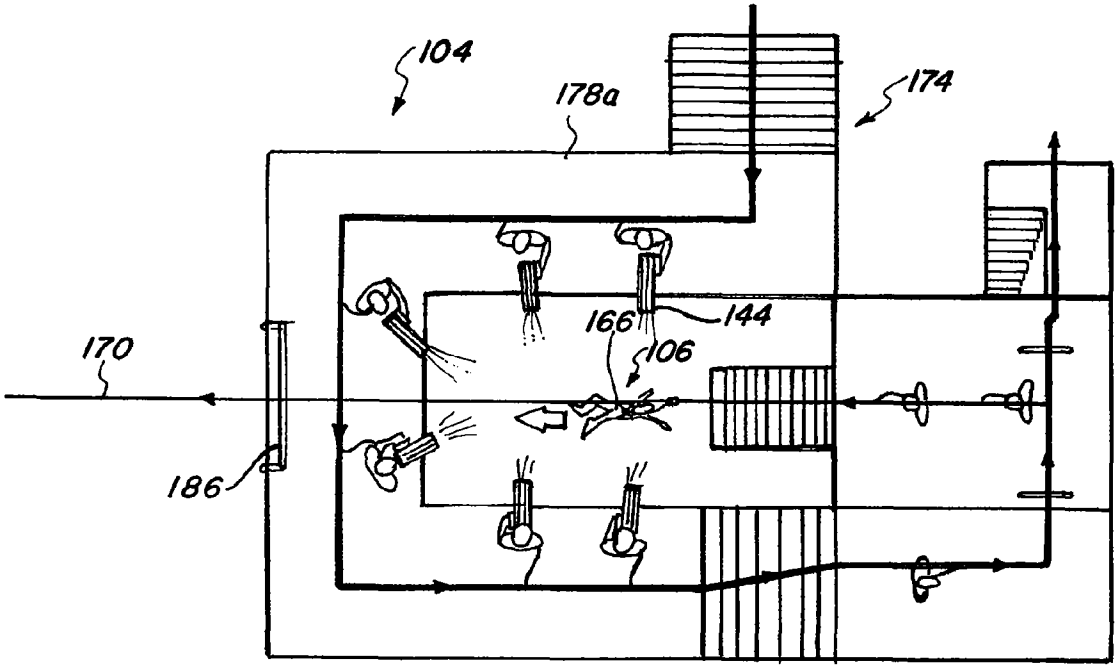
FIGS. 17A and 17B depict a zip-line section and interactive units according to an embodiment of the present invention.
Figure 17B:
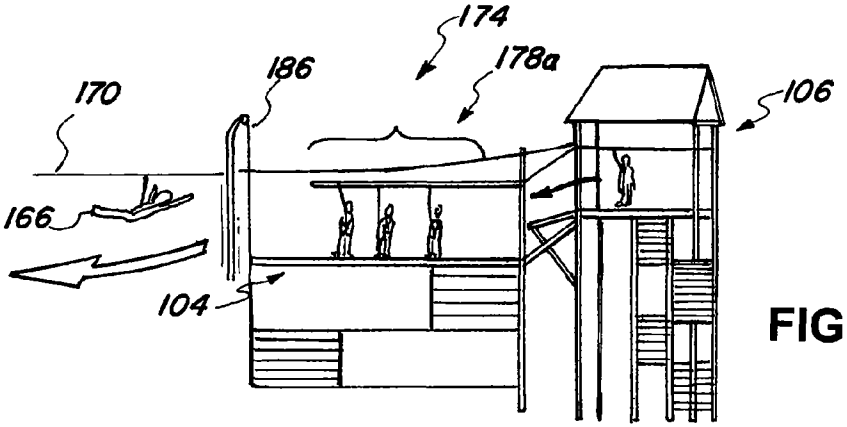
Figure 18A:
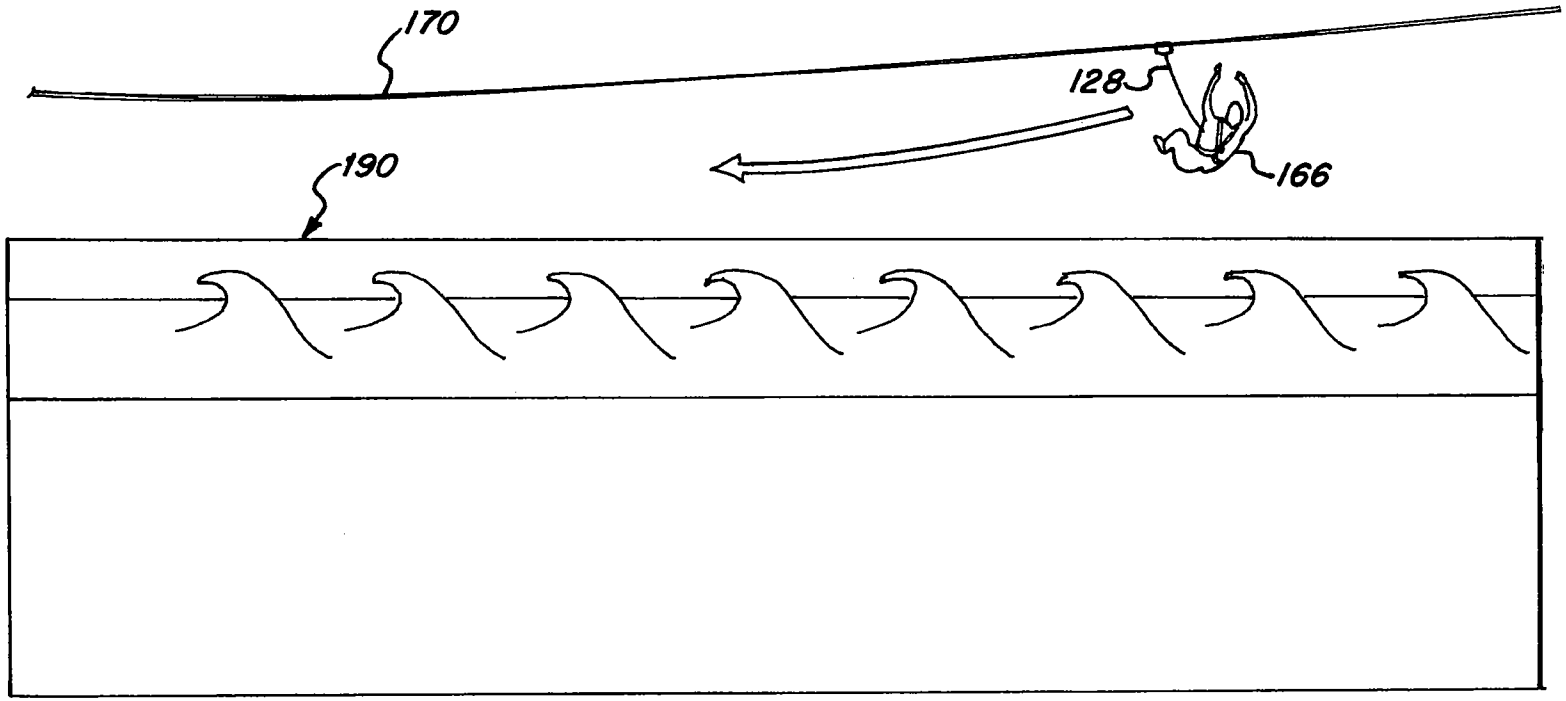
FIGS. 18A and 18B depict a zip-line section according to an embodiment of the present invention.
Figure 18B:
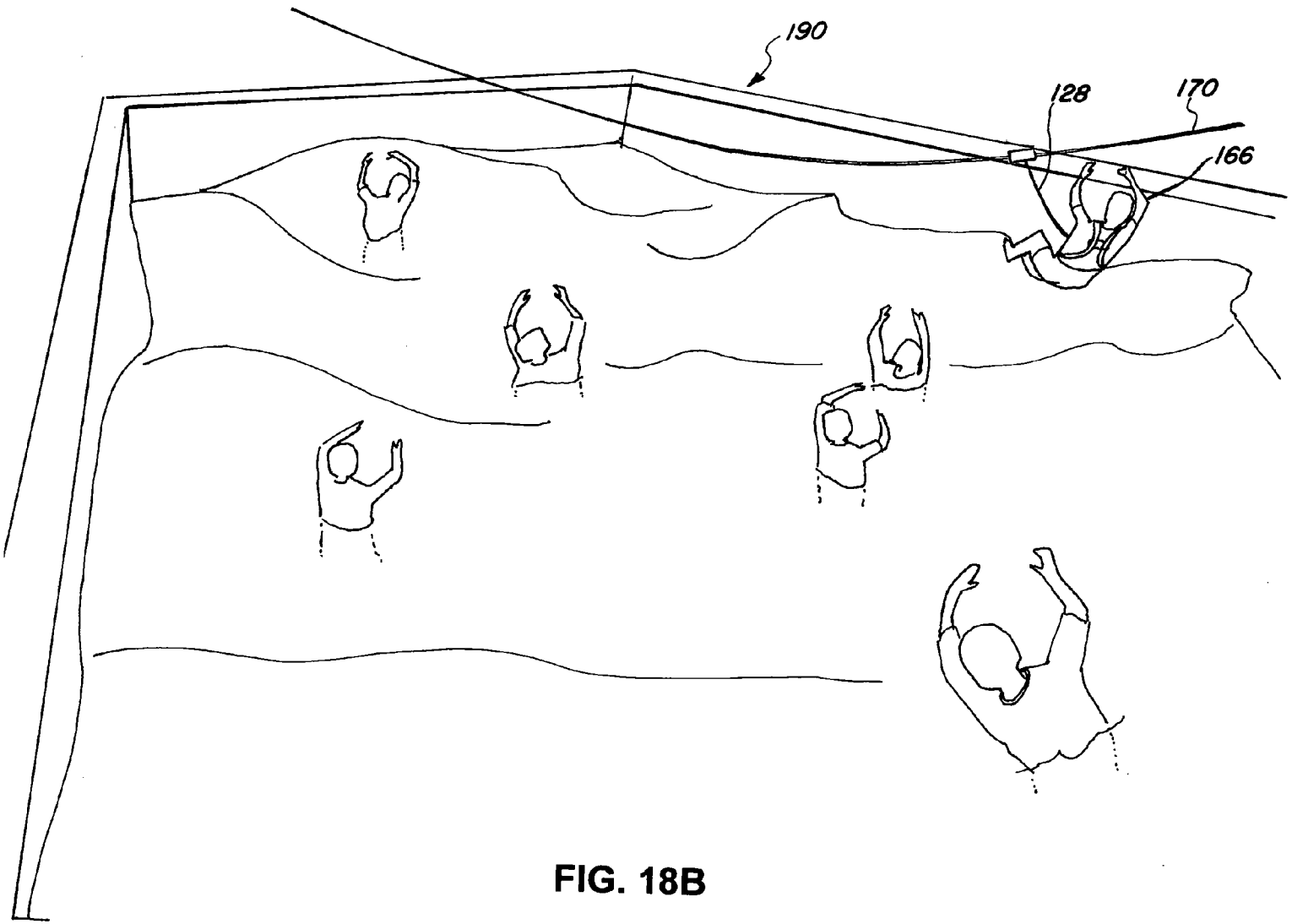

The zip-line section 106 can also be seen in FIGS. 17A and 17B. As can be seen in FIGS. 17A and 17B, the user can traverse through the wall of water 186 along the zip-line 170. In addition, the fluid conduit zone 178*a* can spray water in the start zone 174 onto the user using the fluid conduits 144 as he is traversing along the zip-line 170. As seen in FIG. 18A and FIG. 18B, while the zip-line 170 can have a path over a pool 190. The pool 190 can include other users. The pool 190 can be, for example, part of the non-harnessed course 102 and/or the harnessed course 104. This can provide a thrilling visual experience for the user sliding down the zip-line 170 and the other users in the pool 190 as the user on the zip-line 170 can see the other users in the pool 190, and the other users in the pool 190 can see the user on the zip-line 170. In one embodiment, there is a 15 foot gap between the top of the water in the pool 190 and the zip-line 170.

Figure 19:
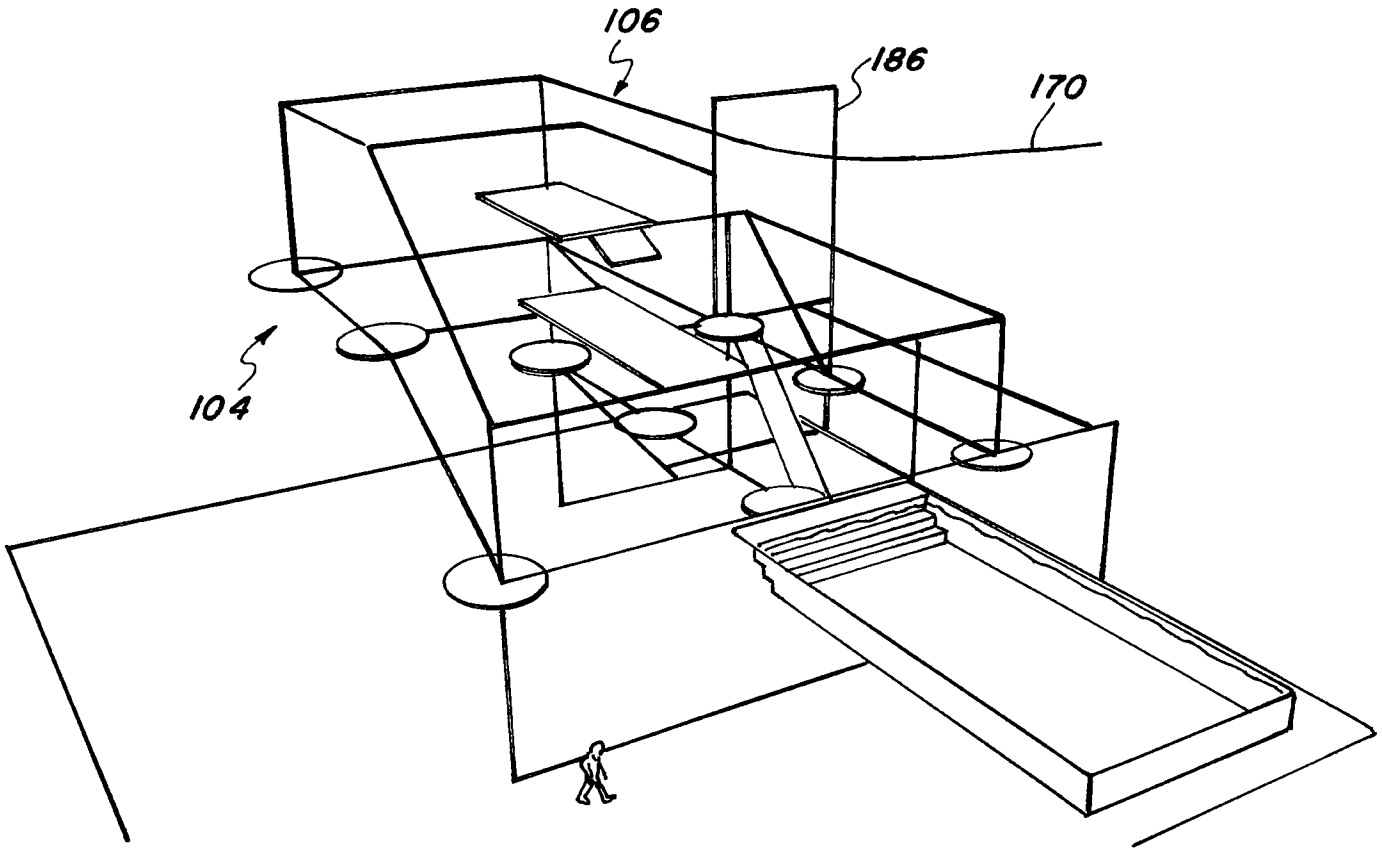
FIG. 19 depicts a harnessed course section and a zip-line section of the wet play structure according to an embodiment of the present invention.
Figure 20:
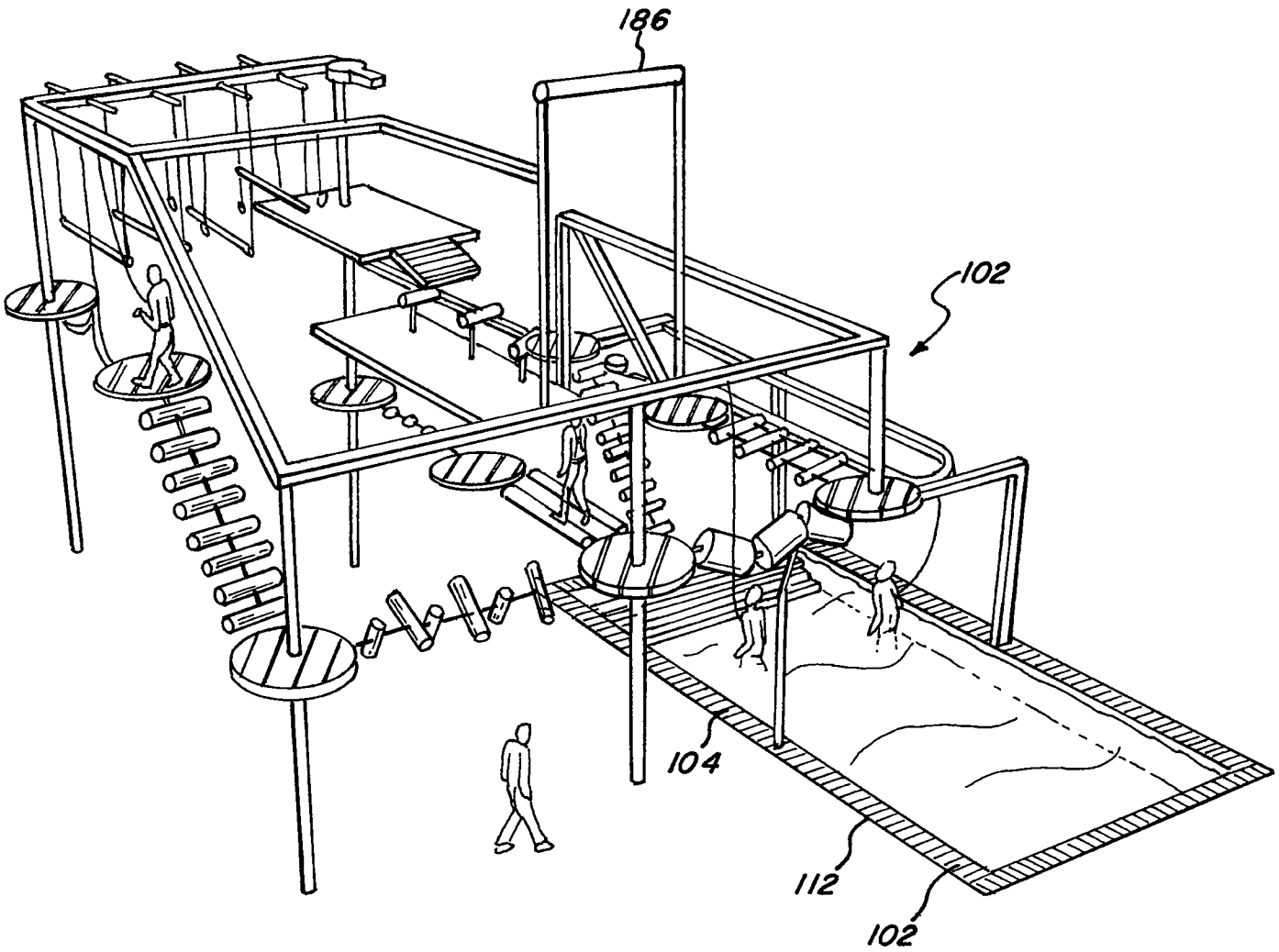
FIG. 20 depicts a harnessed course section and a zip-line section of the wet play structure according to an embodiment of the present invention.
Figure 21A:
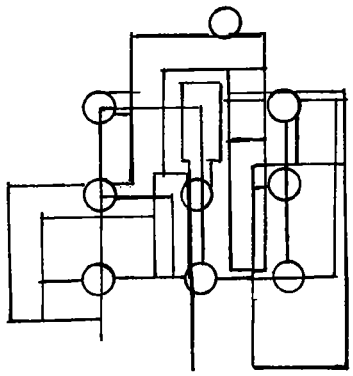
FIGS. 21A and 21B depict a non-harnessed course section, a harnessed course section, and a zip-line section of the wet play structure according to an embodiment of the present invention.
Figure 21B:
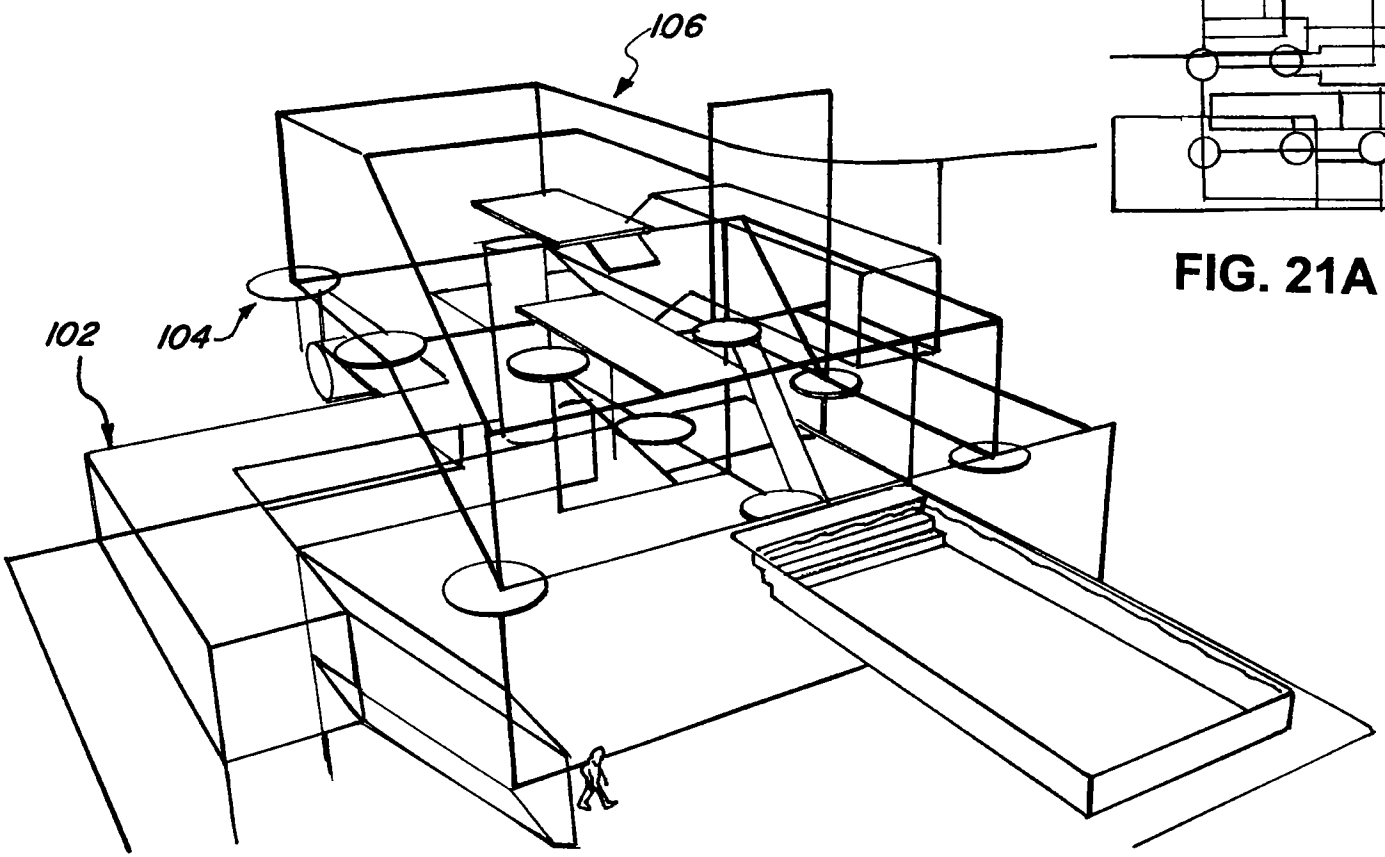
Figure 22A:
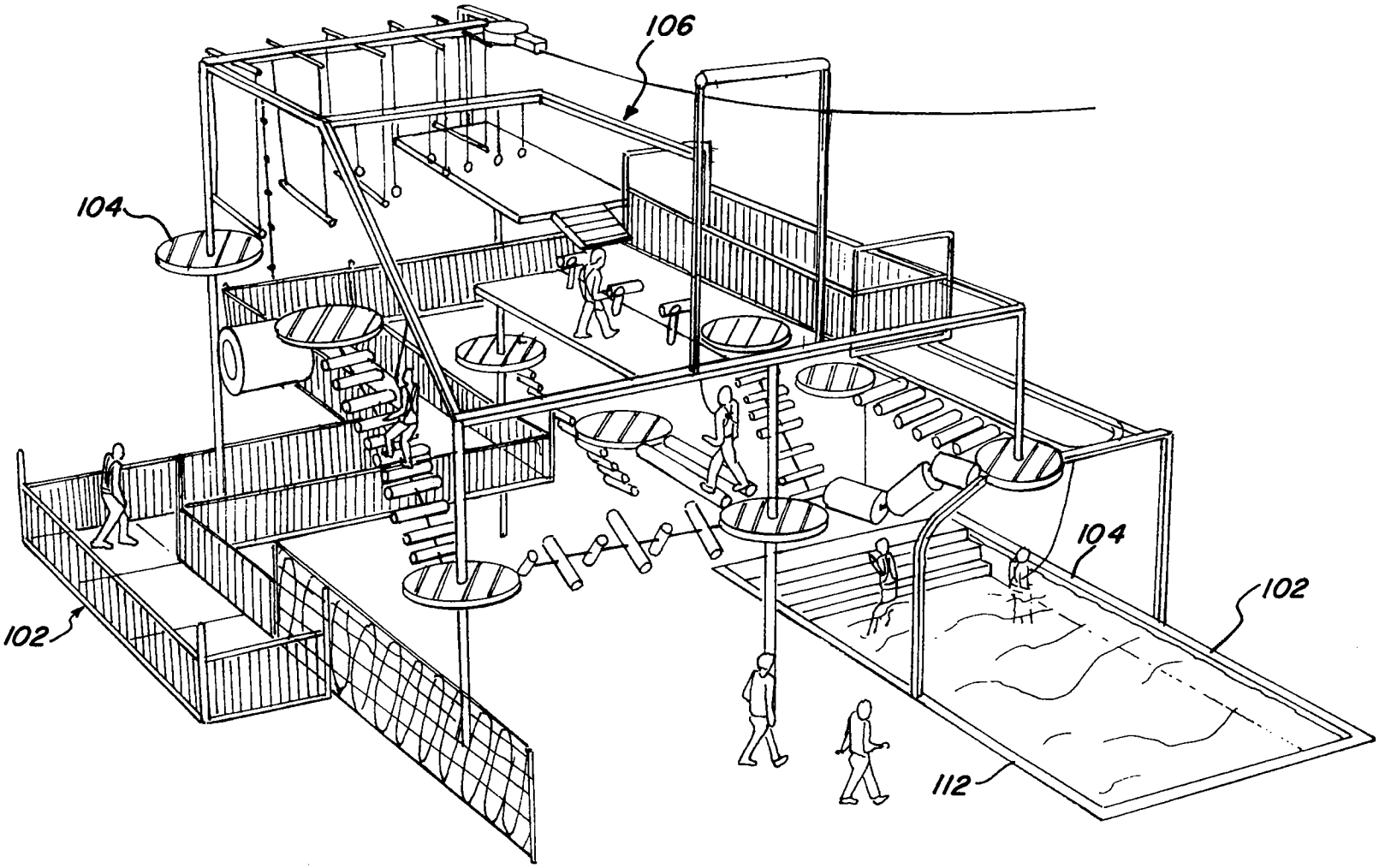
FIGS. 22A-C depict a non-harnessed course section, a harnessed course section, and a zip-line section of the wet play structure according to an embodiment of the present invention.
Figure 22C:
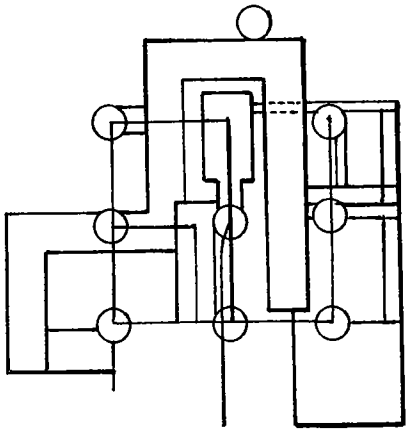
Figure 22B:
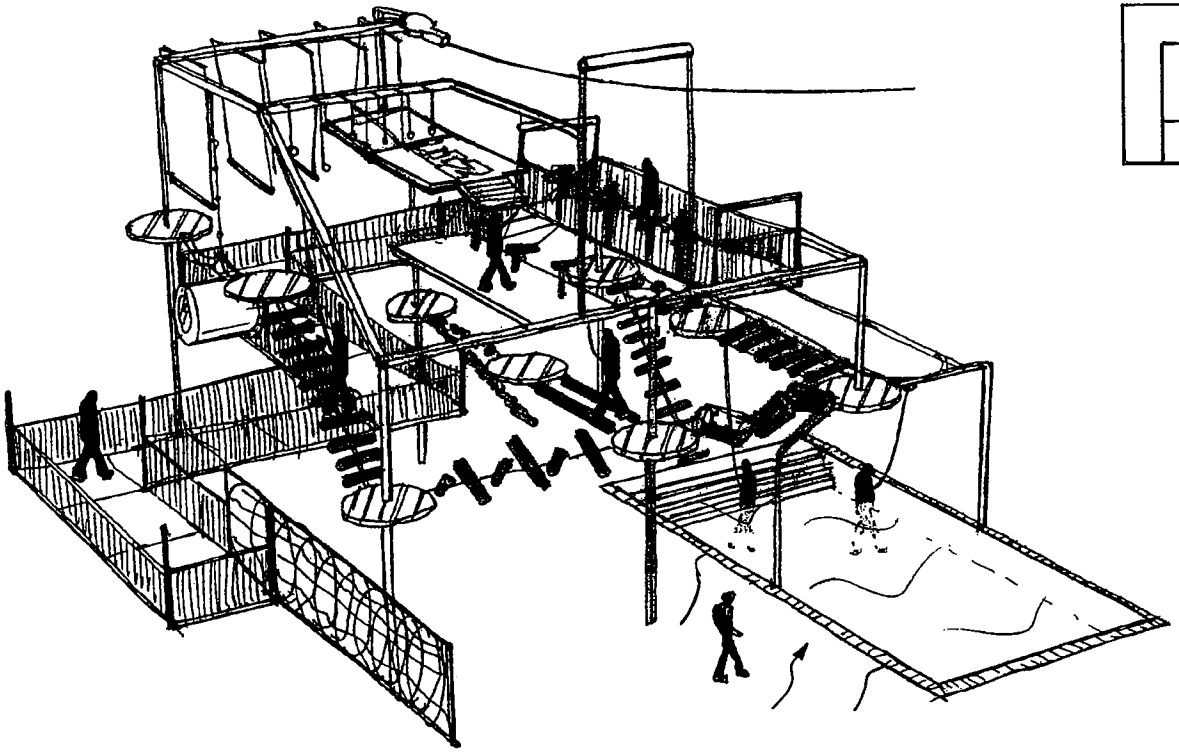

FIGS. 19 and 20 depict additional designs of the harnessed course 104 and the zip-line section 106. FIGS. 21A, 21B, 22A, 22B, and 22C depict additional designs of the non-harnessed course 102, the harnessed course 104, and the zip-line section 106.

Figure 23:
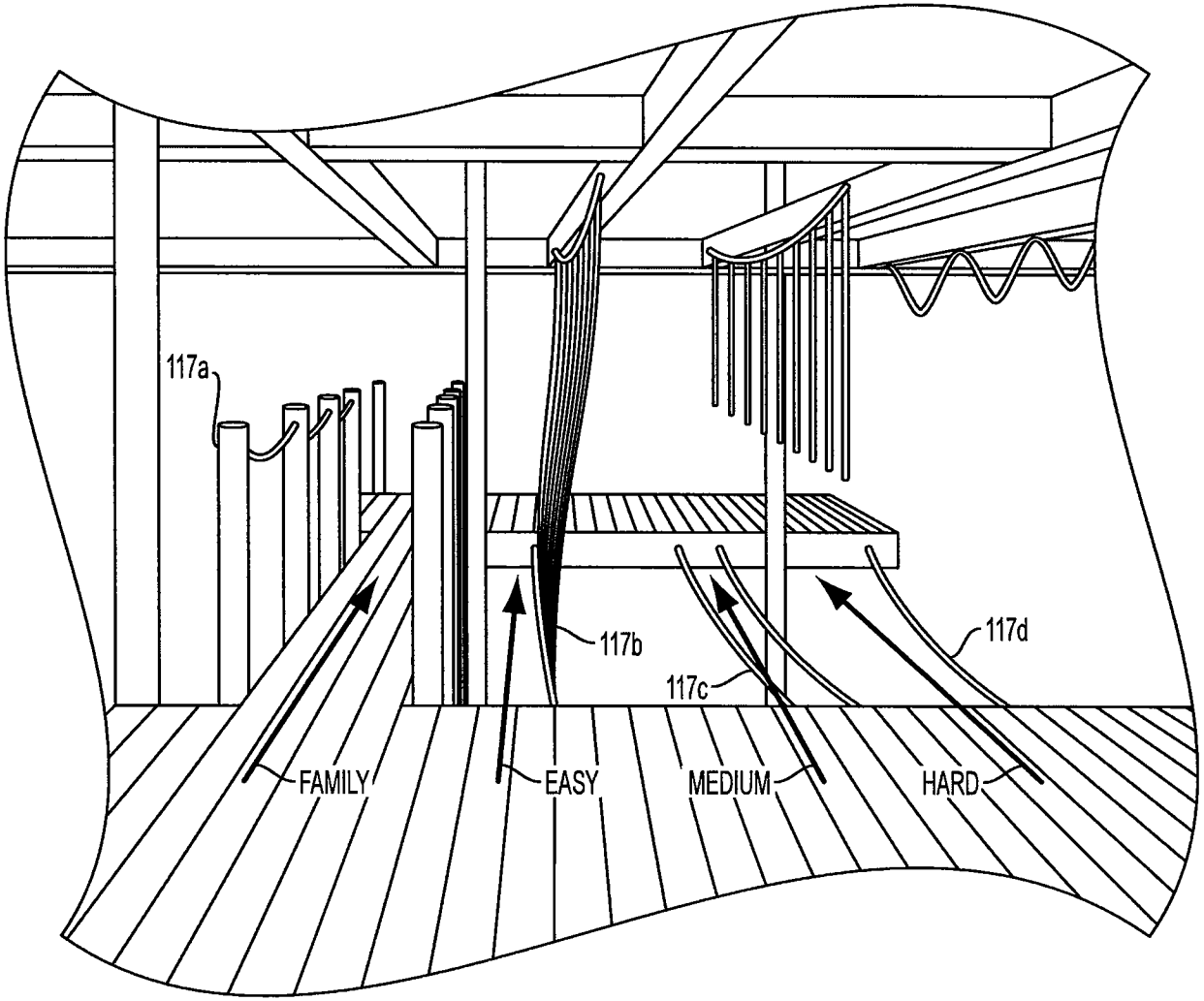
FIG. 23 depicts multiple paths in a non-harnessed course or harnessed course section of a wet play structure according to an embodiment of the present invention.

FIG. 23 depicts a chicken path feature of the water play structure 100. In FIG. 23, the non-harnessed course 102, and/or the harnessed course 104 can have multiple paths that can be taken simultaneously. For example, the non-harnessed course 102, and/or the harnessed course 104 can have a family path, an easy path, a medium path, and/or a hard path. The elevated paths 117*a-d* of the harnessed course 104 may therefore run parallel to each other and may have varying degrees of difficulty a user may face when attempting to traverse respective paths 117*a-d*. The family path can be suitable, for example, for a complete family to traverse. The easy path can be, for example, for beginners or young people to traverse. The medium path can be, for example, for those users who are more experienced. The hard path can be, for example, for those expert users or those users who seek the greatest challenge to traverse. Thus, the wet play structure 100 of the present invention allows greater family or friendly interaction as the users can simultaneously traverse paths together allowing the enjoyment and entertainment to be shared. This can also promote family bonds or friendships.

Any path of the harnessed course 104 or non-harnessed course 102 may include fluid conduits capable of transmitting fluid onto a user of the path. One of the major drawbacks of a conventional harnessed course is the heat generated by traversing the harnessed course. By including fluid conduits in the form of water elements and interactions in the harnessed course 104, the user can be cooled. In addition the fluid conduits can raise the excitement and the level of difficulty of the harnessed course 104 as desired. This can increase the enjoyment of the user.

Figure 24:
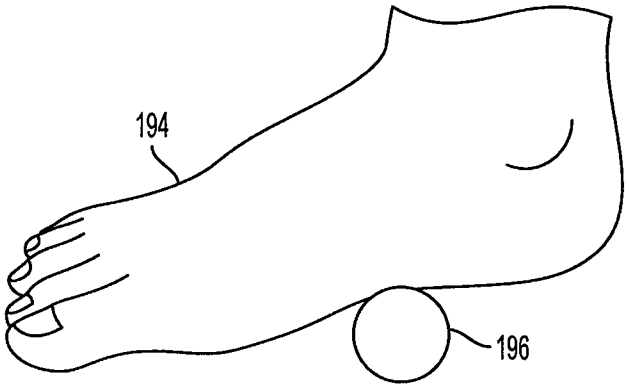
FIG. 24 depicts a bare foot on a conventional support structure.

FIG. 24 depicts a bare foot 194 on a conventional support structure 196 with a diminutive size. As can be seen, the bare foot 194 is not supported very well by the conventional support structure 196. That is, the bare foot 194 may feel uncomfortable as pressure is concentrated in a small area of the bare foot 194. In addition, the diminutive size of the conventional support structure 196 may not inspire confidence in the user and also may make it harder for the user to retain his balance.

Figure 25:
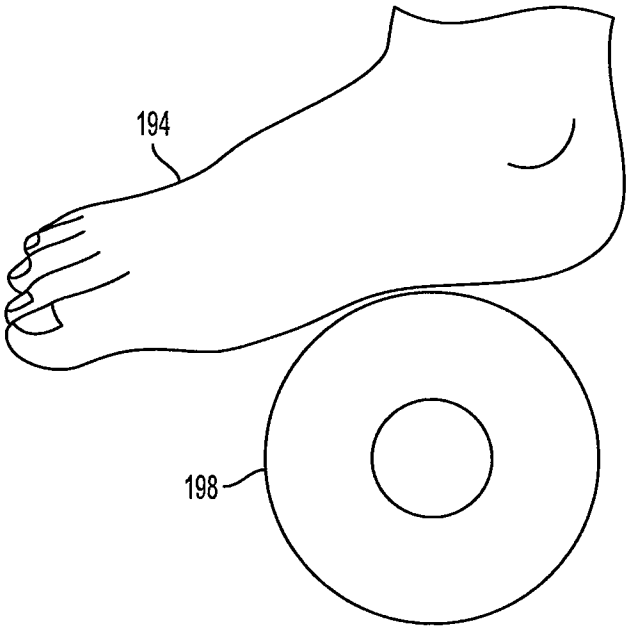
FIG. 25 depicts a bare foot on a support structure according to an embodiment of the present invention.

In contrast, as seen in FIG. 25, the bare foot 194 is supported by the support structure 198 of the present invention. The support structure 198 of the present invention can have a larger size and/or a textured surface. For example, the support structure 198 has a greater diameter than the conventional support structure 194 and can also have a textured surface. This allows for the pressure to be spread over a larger area of the bare foot 194, which can lead to a more relaxing and pleasant sensation. In addition, the larger size and/or the textured surface of the support structure 198 can inspire confidence in the user and also may make it easier for the user to retain his balance.

Figure 26:
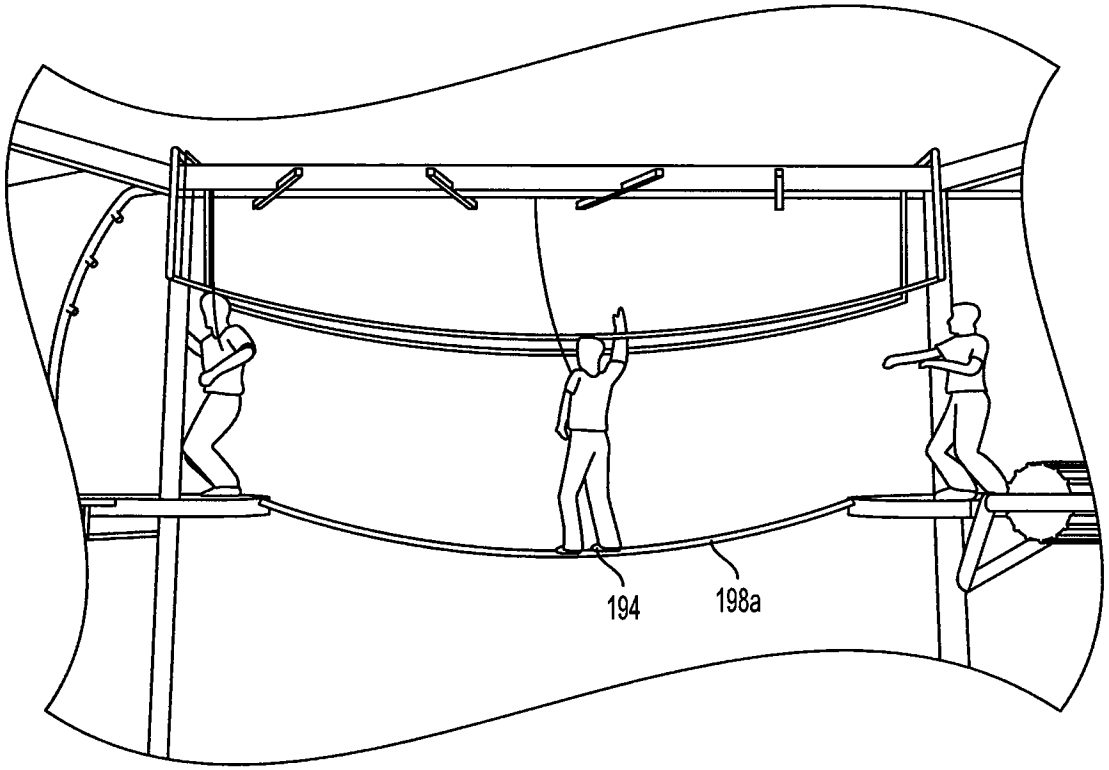
FIGS. 26-29 depict various shapes of the support structure according to an embodiment of the present invention.
Figure 27:
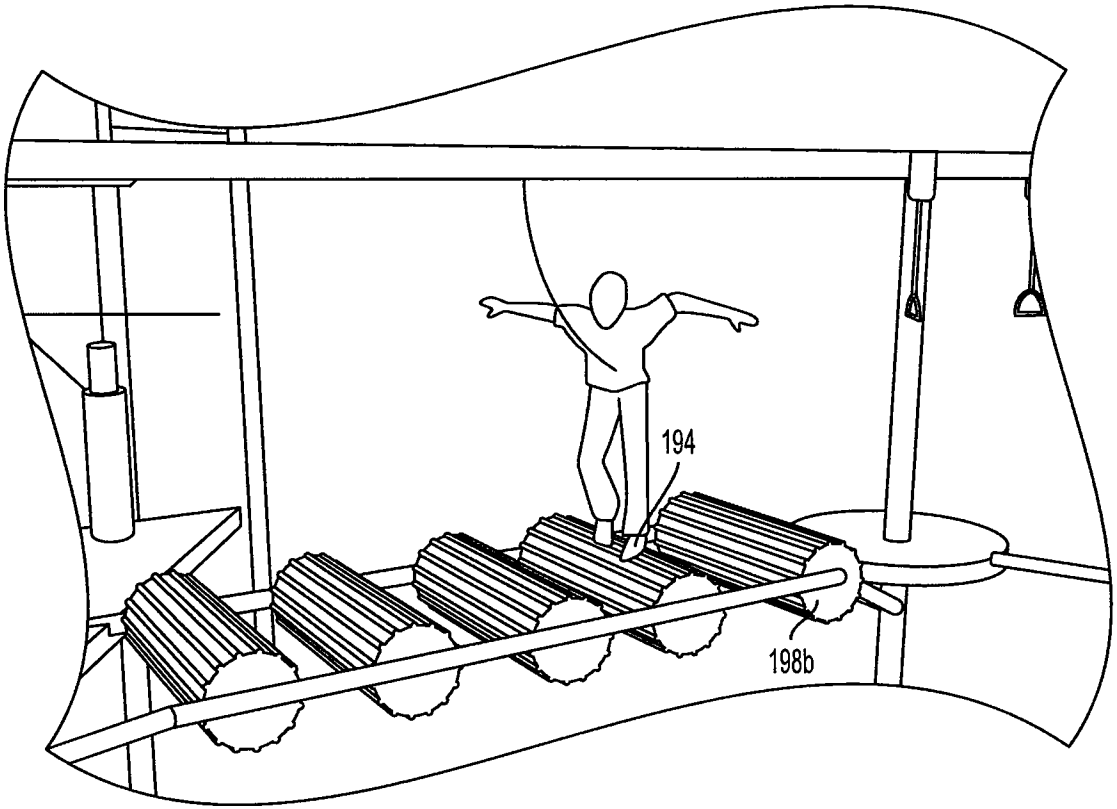
Figure 28:
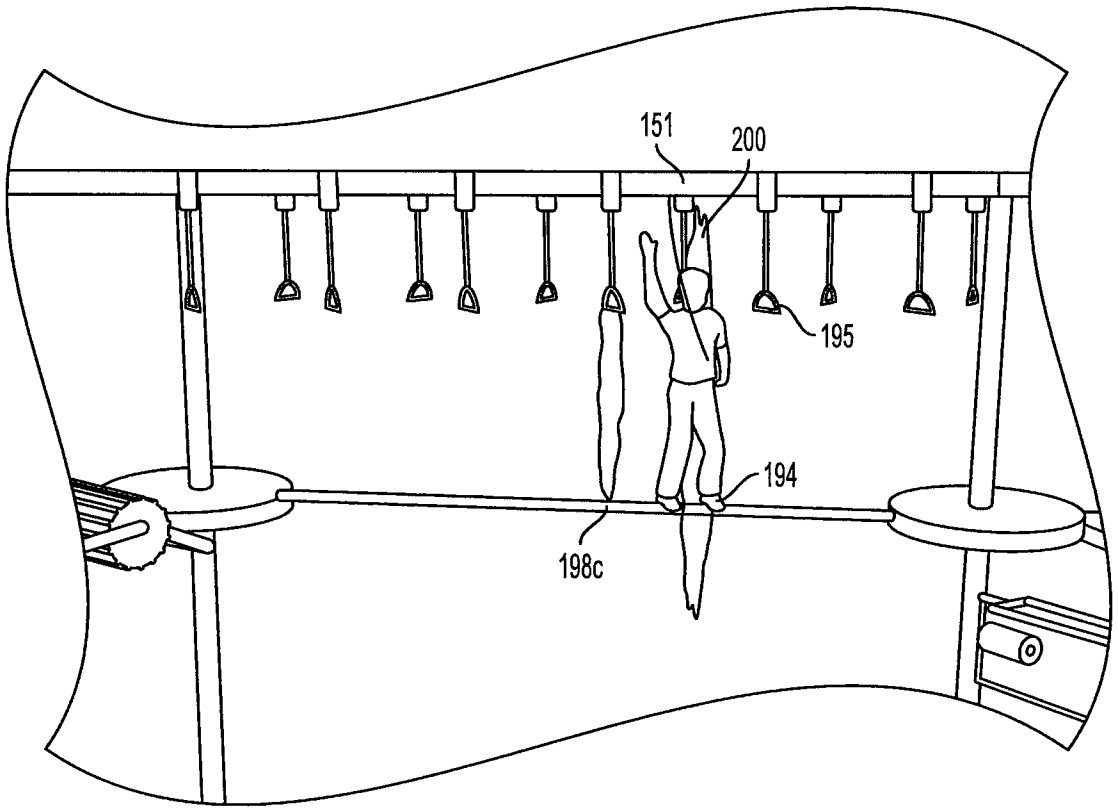
Figure 29:
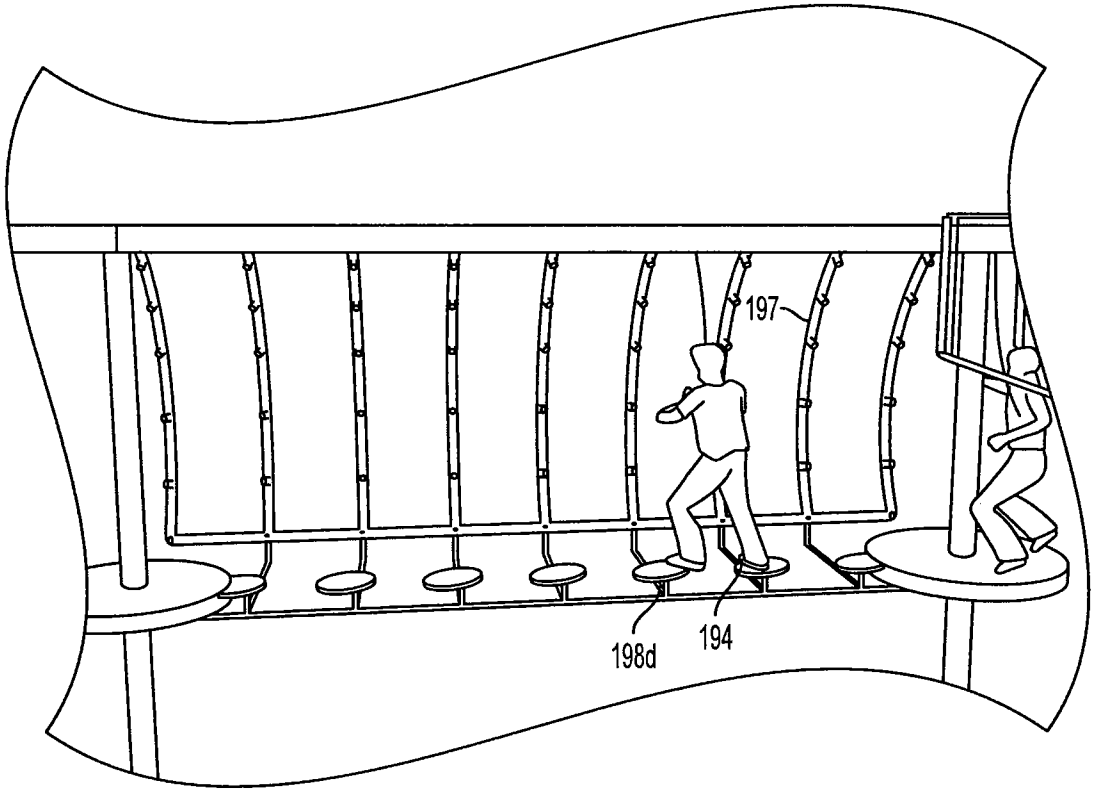

The support structure 198 may form a path for the user to traverse, and can also have various shapes, such as those shown in support structure 198*a*, 198*b*, 198*c*, and 198*d* in FIGS. 26, 27, 28, and 29 respectively. The support structures 198*a-d* form obstacles for the users to traverse. FIG. 26 illustrates the support structure 198 as an obstacle in the form of a rope the user steps on to traverse the path. FIG. 27 illustrates a support structure 198*b* as an obstacle in the form of rollers used in a moving bridge. FIG. 28 illustrates a support structure 198*c* as an obstacle in the form of a beam 198*c* the user crosses. FIG. 28 additionally illustrates monkey bars 195 as an obstacle a user may grab. FIG. 29 shows a support structure 198*d* as an obstacle in the form of a rope 197 the user may grasp for support. In addition, as shown in FIG. 28, the larger size and/or the textured surface of the support structure 198*c* may also be especially beneficial when, for example, water 200 is splashed on the user and/or the support structure 198*c* from a fluid conduit 151 in the form of a water spray device. A fluid conduit may be integrated with any portion of the elevated paths shown in FIGS. 26-29, or any other elevated path shown in this application. The larger size and/or the textured surface of the support structure 198 translates into a larger surface area for the barefoot 194 to grip the support structure 198, which can be useful in wet conditions. In one embodiment, the support structure 198 can also be optionally rotated with the rate of rotation or rotational ease controlled or set according to a user's ability level and/or the difficulty of the path in which the support structure 198 is located.

Figure 30:
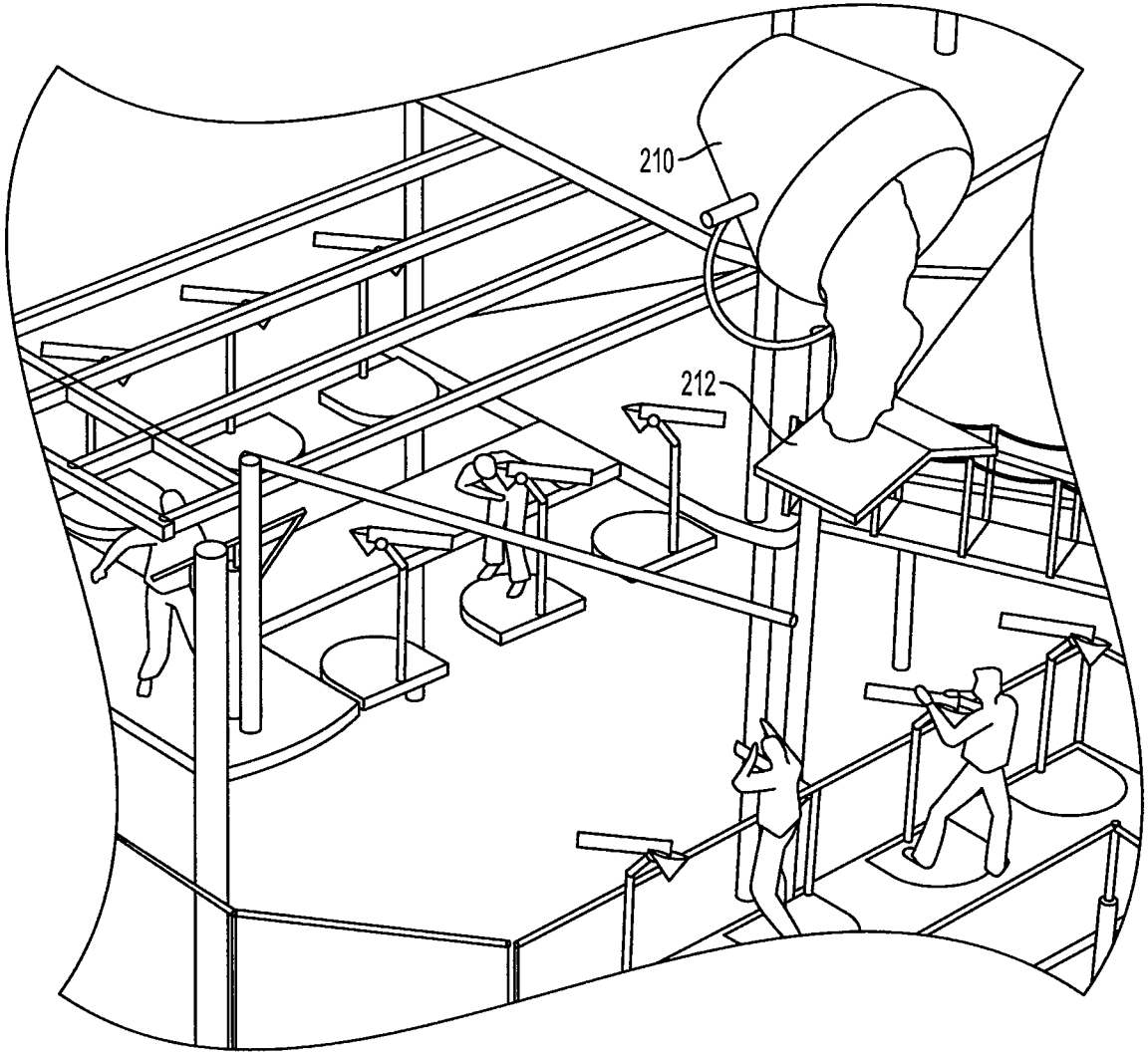
FIG. 30 depicts a tipping bucket in a water play structure according to an embodiment of the present invention.

In one embodiment, the present invention can include, for example, a fluid conduit in the form of a tipping bucket 210 having a deflection shield 212 as seen in FIG. 30. The tipping bucket 210 can be, for example, the tipping bucket disclosed in Briggs, U.S. Pat. No. 5,820,471, entitled "PARTICIPATORY WATER PLAY SYSTEM," which is hereby incorporated by reference in its entirety. The tipping bucket 210 can be filled with water, eventually tipping its contents onto the deflection shield 212 and over the users below. The tipping bucket 210 can be located, for example, in the non-harnessed course 102, and/or the harnessed course 104. The tipping bucket 210 may serve as a fluid conduit transferring fluid onto a user of the harnesses course 104 or non-harnessed course 120. In some embodiments, the tipping bucket 210 can also be located along portions of the zip-line section 106.

Figure 31:
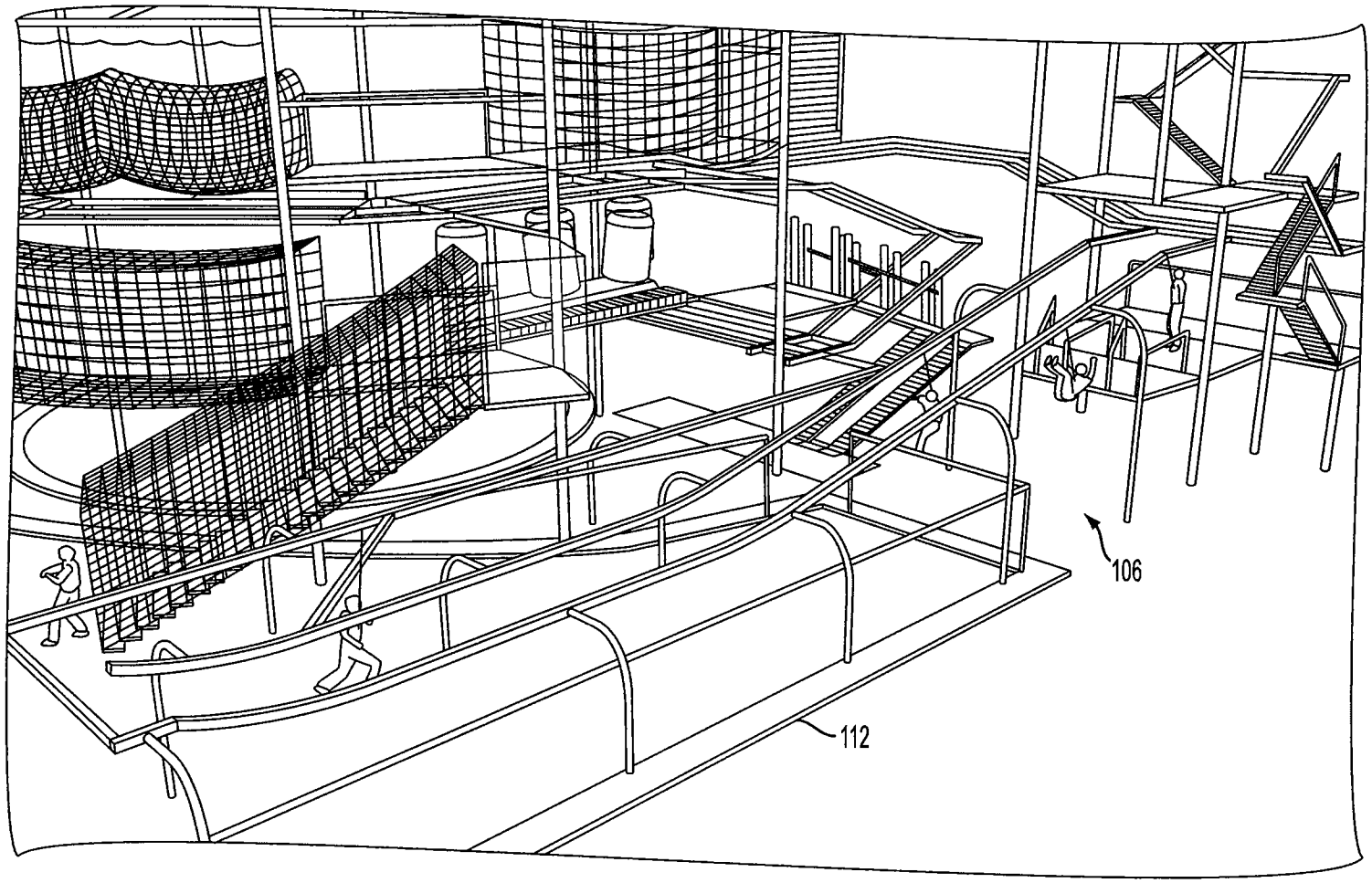
FIG. 31 depicts a zip-line section according to an embodiment of the present invention.

FIG. 31 depicts a zip-line section 106 which traverses the pool 112. Users may slide and splash into the pool 112 after traveling on the zip-line.

Figure 32:
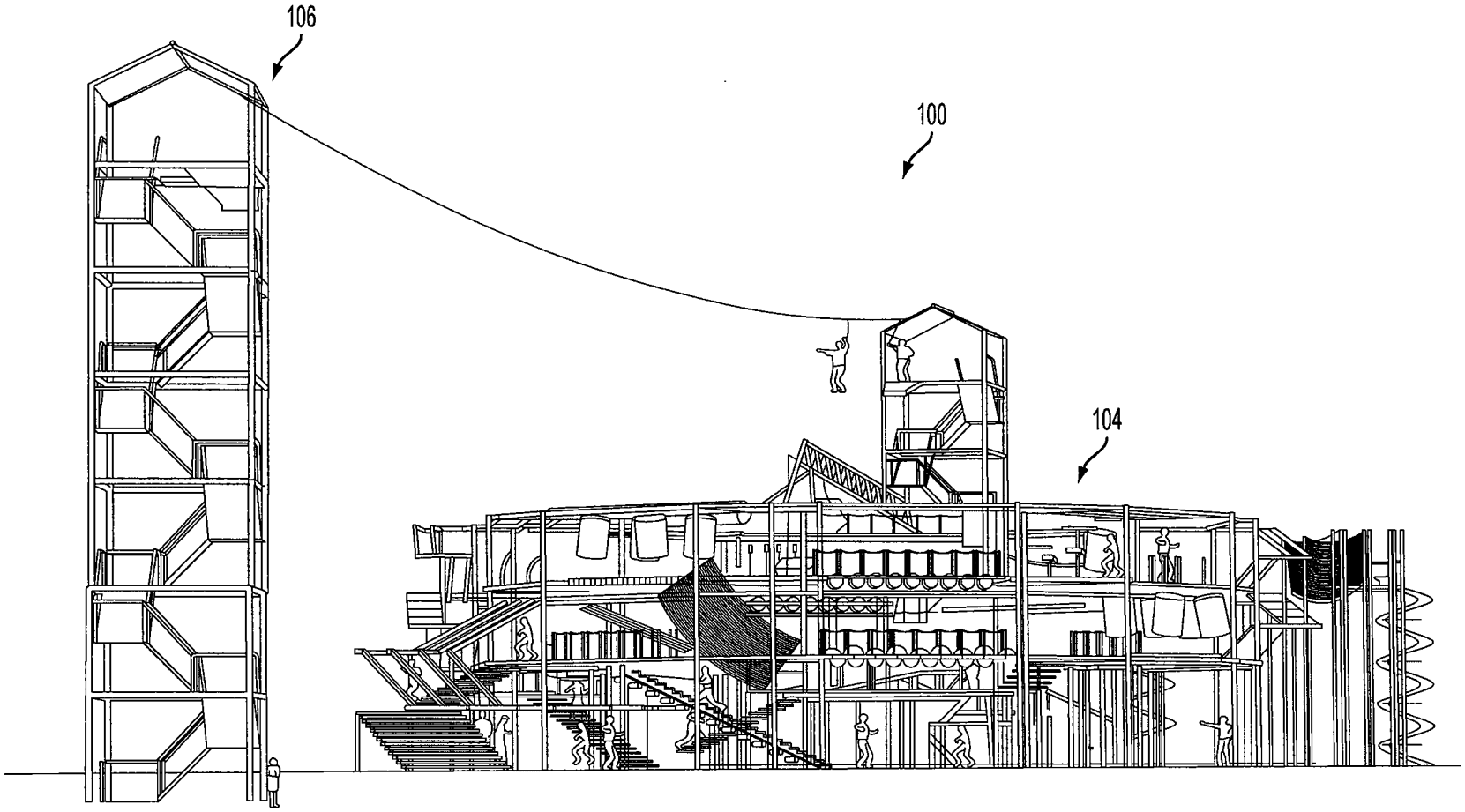
FIGS. 32-37 depict a wet play structure according to an embodiment of the present invention.

FIG. 32 illustrates the wet-play structure 100 as a multi-leveled structure including multiple levels of a harnessed course 104 and non-harnessed course 102 integrated together. A zip-line section 106 allows a user to travel to or from the wet play structure 100, or within the wet play structure 100.

Figure 33:
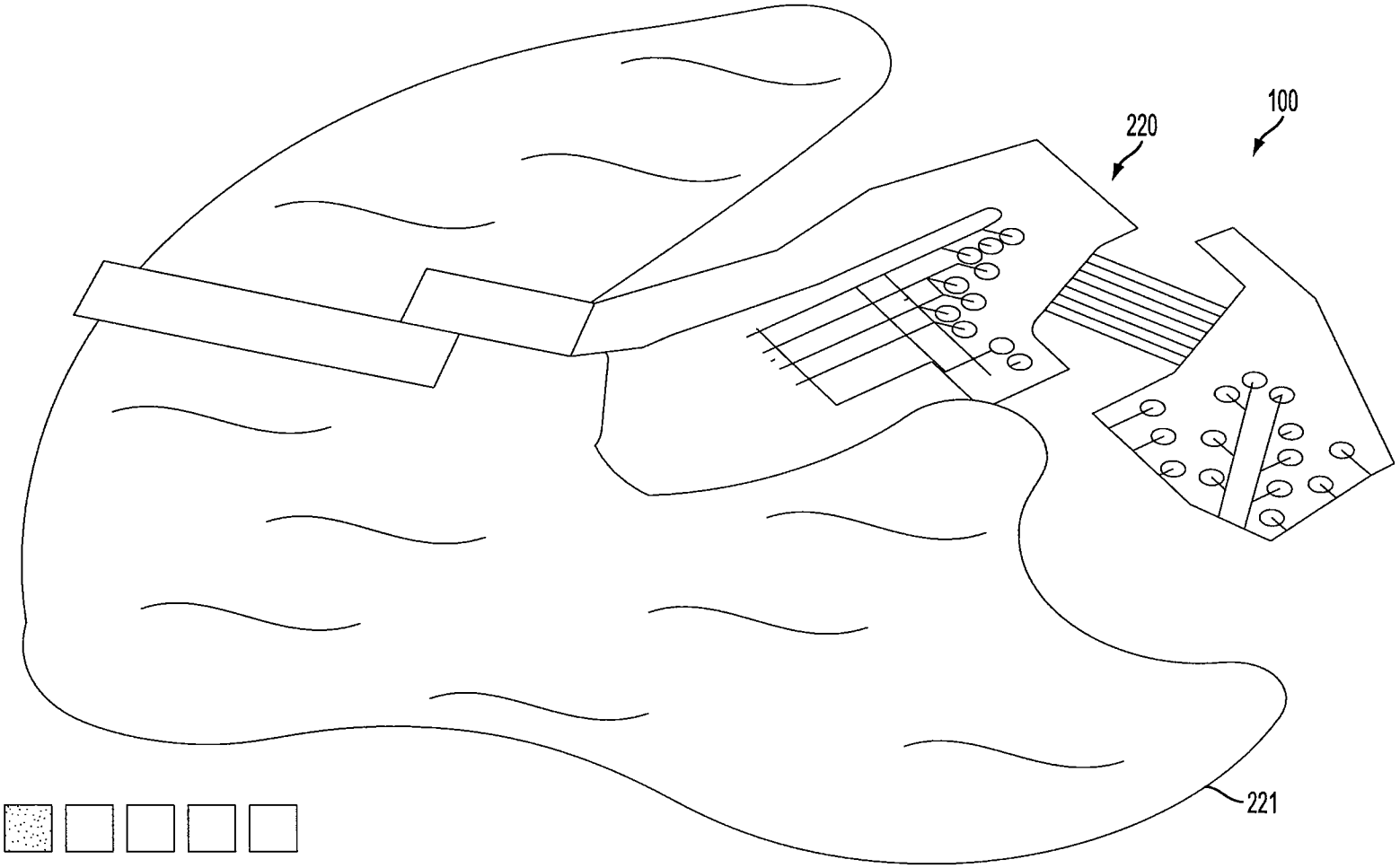

FIGS. 33-37 illustrate the layered construction of the wet play structure 100 according to one embodiment of the present invention. FIG. 33 illustrates a ground level of the wet play structure 100 including a queuing area 220 and a pool 221. The queuing area 220 includes an area in which a user can put on a harness to wear while traversing the elevated paths of the harnessed course 104. The harness is bathing suit friendly, and can be intuitive to use. The queuing area 220 may include a harness rack with the harnesses placed thereupon. The users wait in the queuing area 220 until instructed by an instructor that they should retrieve a harness from a harness rack. The users can grab the appropriate harnesses that fit them. For example, the harnesses can be a small size, a medium size, a large size, or an extra-large size. Any number of harness sizes can also be used.

The pool 221 is capable of being filled with water. An individual may wade, swim, or walk in the pool 221.

Figure 34:
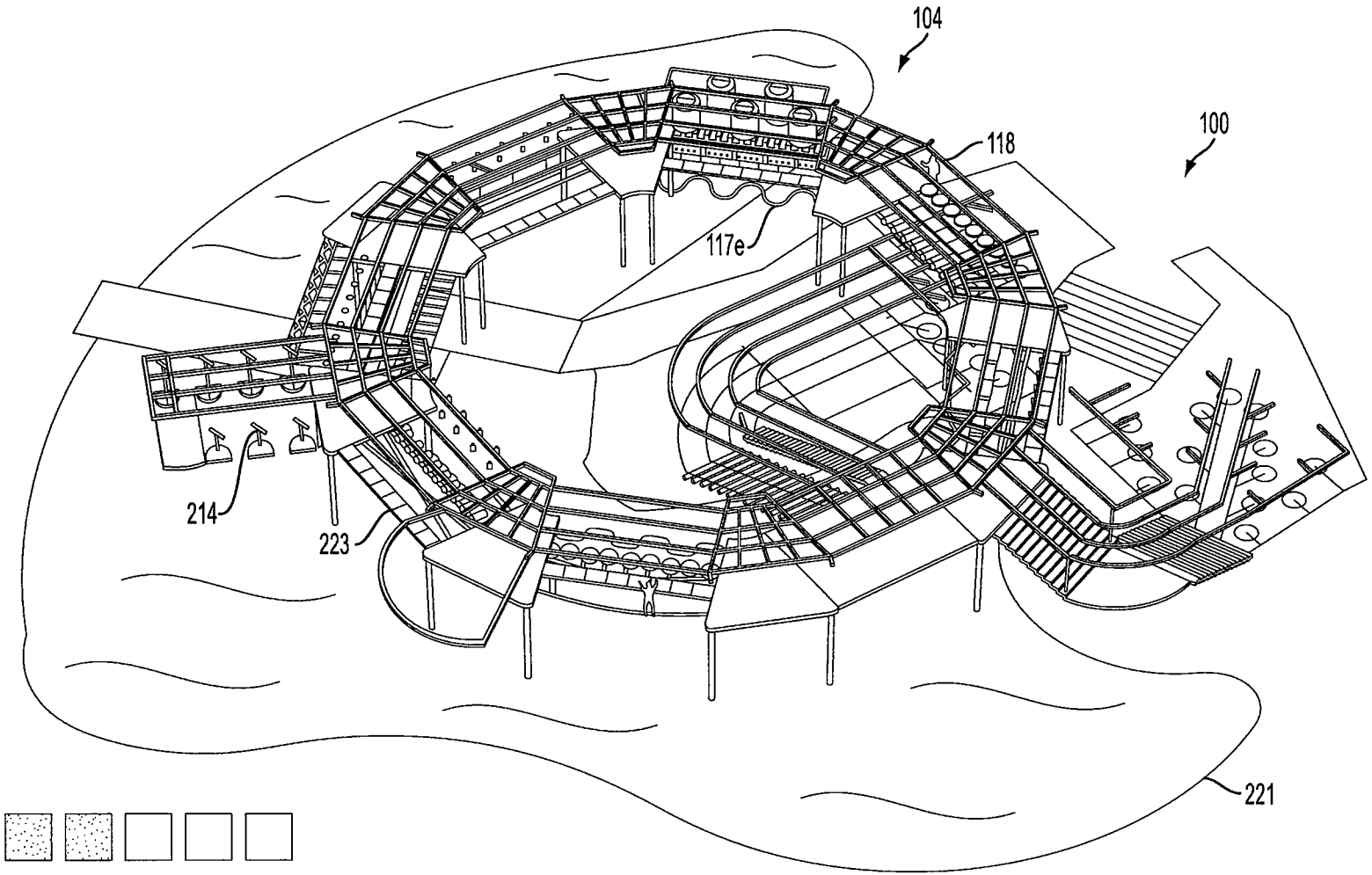

FIG. 34 illustrates a first level 223 of the wet play structure 100 including elevated paths 117*e* configured to allow a user to traverse the elevated path. The track 118 above the elevated path 117*e* is configured to connect to the harness worn by the user while the user traverses the elevated path 117*e*. In FIG. 34, the first level 223 of the wet play structure 100 is circular in shape, although any other shape that allows a user to traverse a path may be used. FIG. 34 additionally illustrates fluid conduits 214 in the form of water shooting devices. The fluid conduits 214 in the form of a water shooting device may also be used in the pool 221. The water shooting device can include a base and a water gun. The user can be supported by the base and can use the water gun to fire water at other users. The fluid conduits 214 in the form of a water shooting device can be part of the non-harnessed course 102, and/or the harnessed course 104. In one embodiment, the water shooting device can be fixed to the ground. In another embodiment, the water shooting device can be floating so that the users can move around the pool 221 on the water shooting device.

Figure 35:
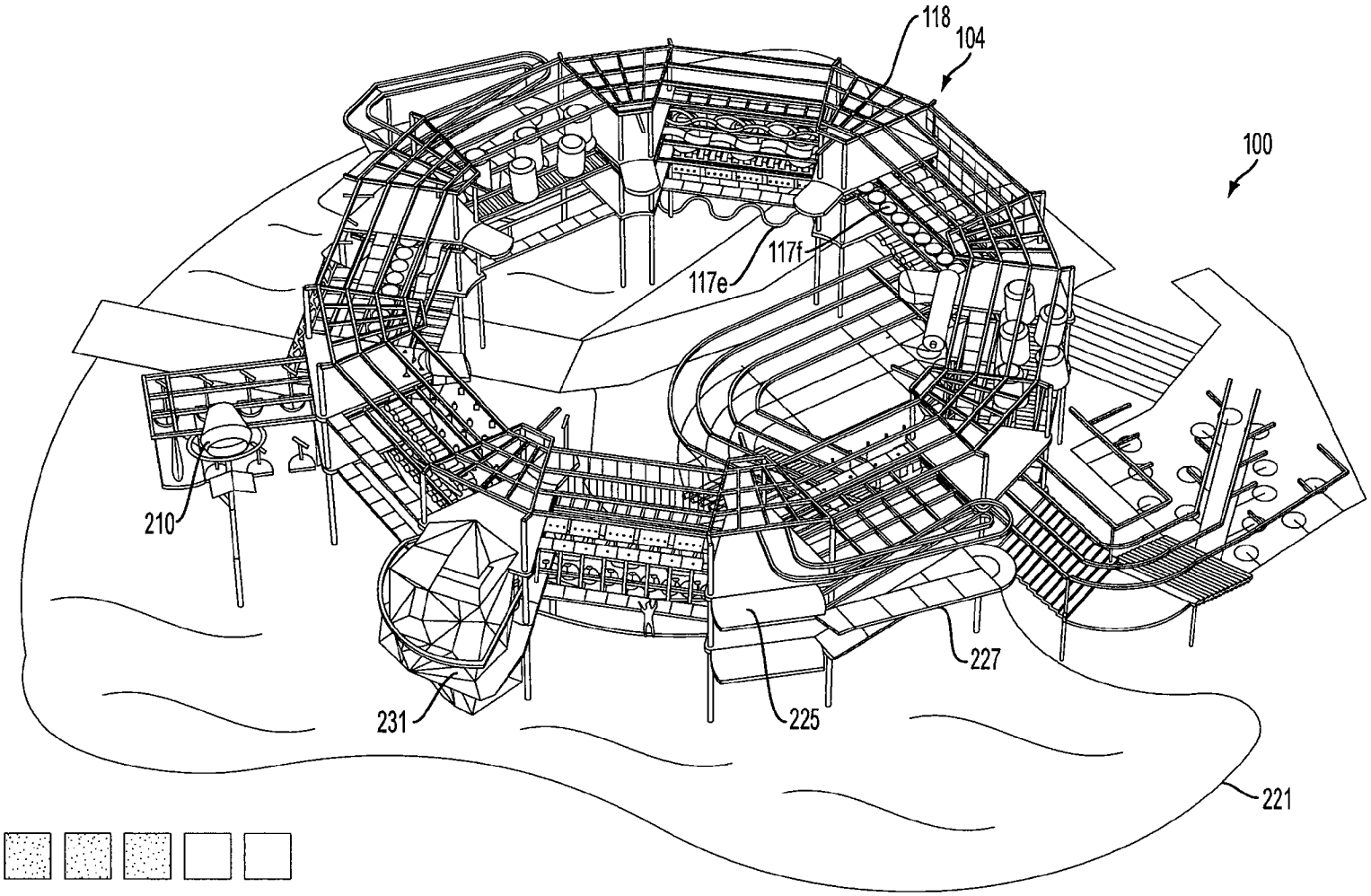

FIG. 35 illustrates the second level 225 of the wet play structure 100 forming paths 117*f* above the paths 117*e* of the first level 223 shown in FIG. 34. FIG. 35 additionally illustrates a path 227 leading from the first level 223 shown in FIG. 34 to the second level 225 shown in FIG. 34. FIGS. 34 and 35 illustrates multiple obstacles a user may cross to traverse the paths of the harnessed course 104 including a rail, a movable bridge, pods, a rope, monkey bars, and the like. FIG. 35 additionally illustrates a climbing surface 231 a user may either climb or travel around to traverse. FIGS. 34 and 35 additionally include numerous fluid conduits that may be used to transmit water onto a user of the harnessed course 104. Such fluid conduits may include the fluid conduits 214 shown in FIG. 34, or the tipping bucket 210 shown in FIG. 35. In addition, such fluid conduits may include the fluid conduits 151 shown in FIG. 28 which may be integrated into any portion of the track 118 or any structural element of the wet play structure 100 including any vertical supports or struts, or any platform or structure on an elevated part of the wet play structure 100 or the ground.

Figure 36:
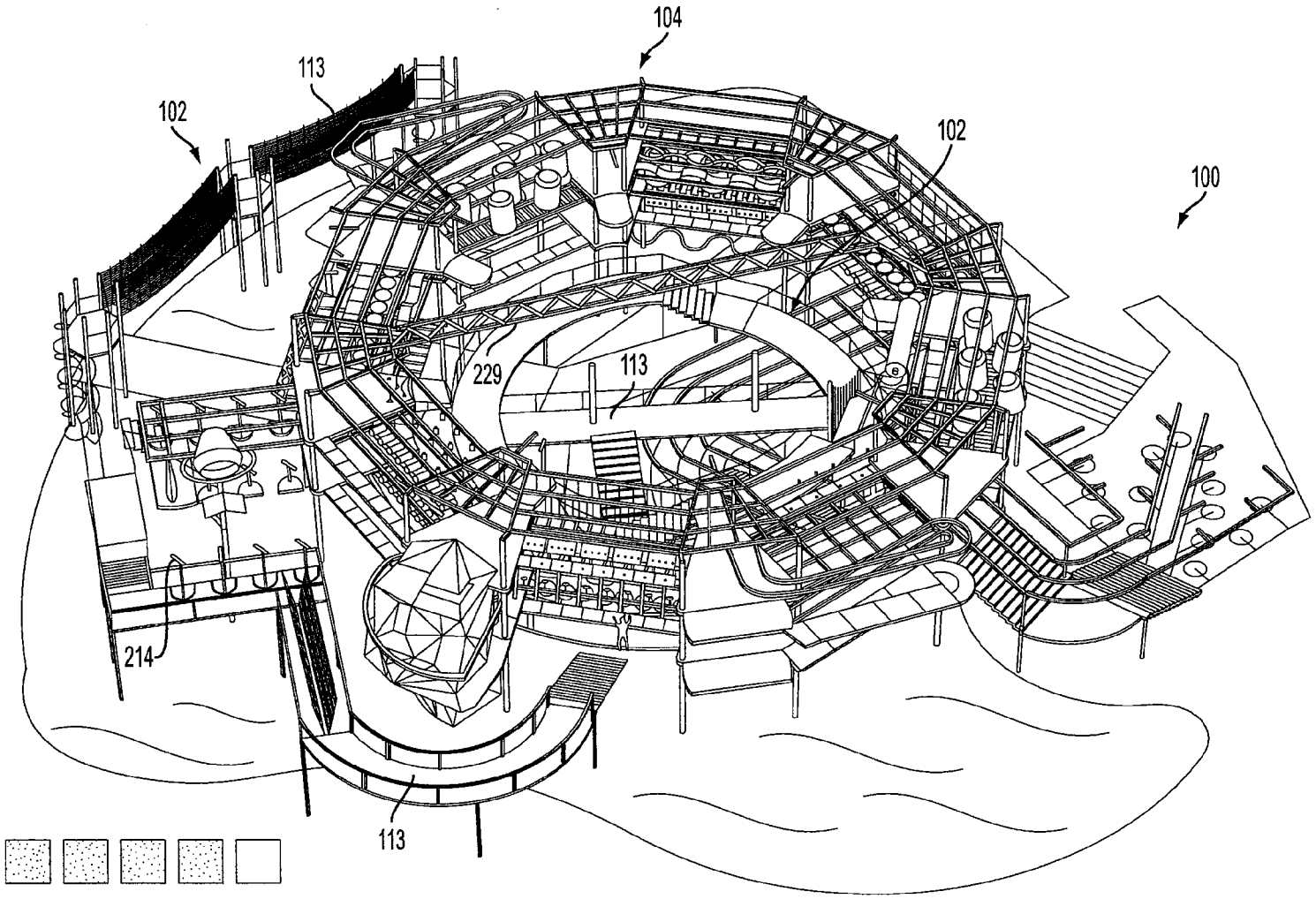
Figure 37:
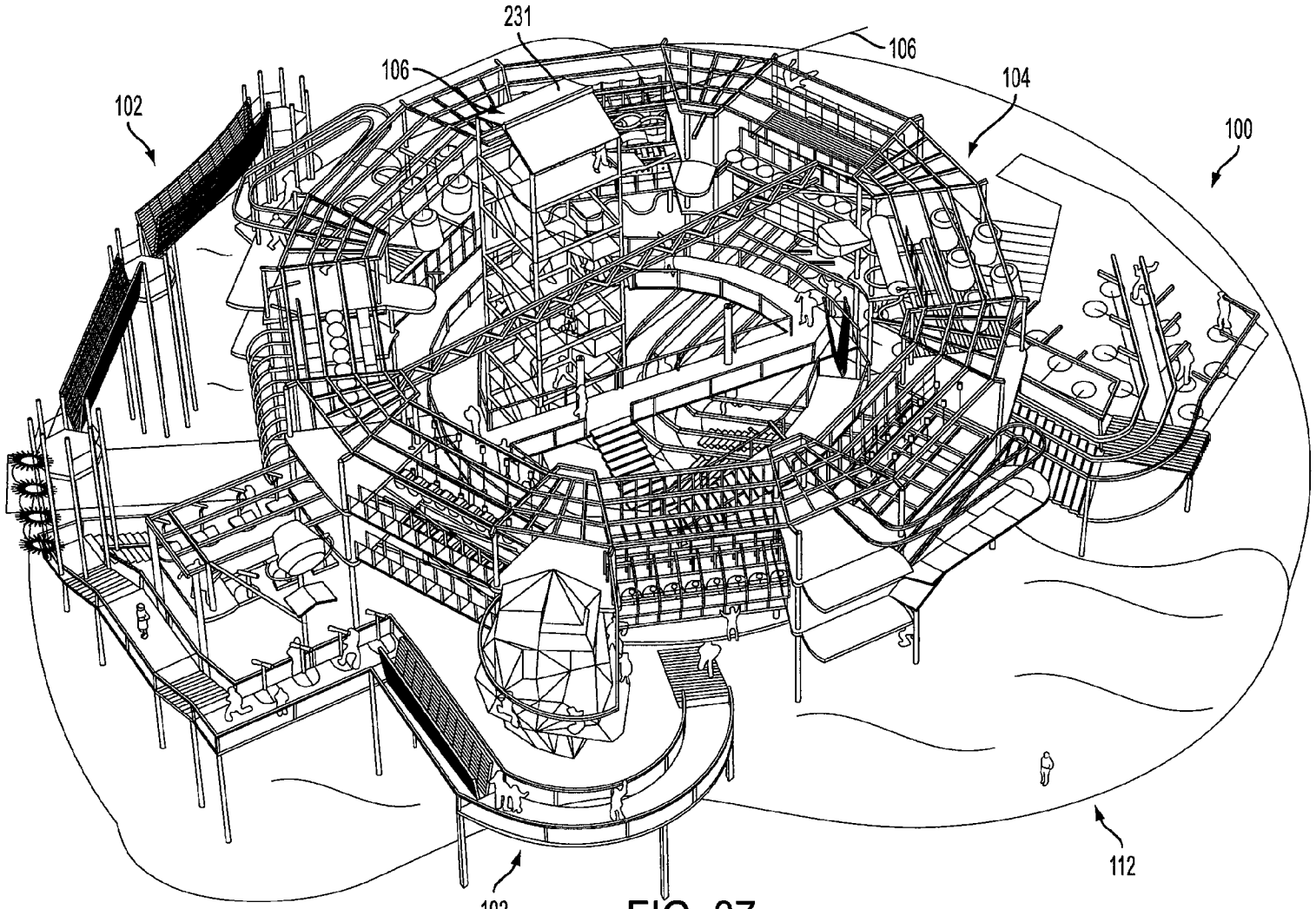

FIG. 36 illustrates an additional level of the wet play structure 110 including a non-harnessed course 102 with non-harnessed pathways 113 integrated with the harnessed course 104. In addition, a zipline 229 is shown extending over a section of the wet play structure 100. The user of the zipline 229 travels over users of the non-harnessed course 102, increasing the excitement for users of the non-harnessed course 102. FIG. 37 illustrates a zipline section 106 including a zipline tower 231 that users of the harnessed courses 104 or non-harnessed course 102 may use.

Figure 38:
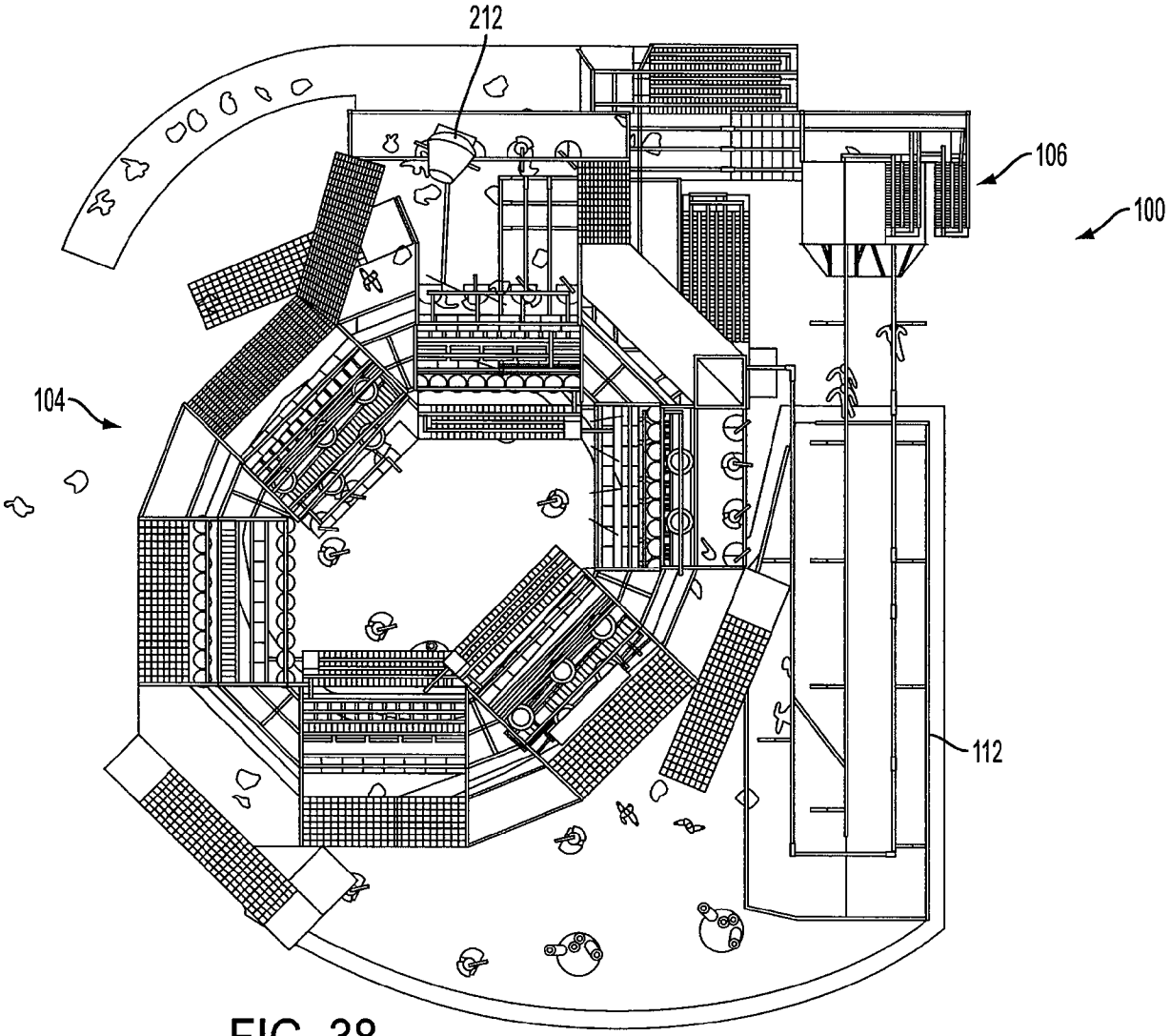
FIG. 38 is an overview of a configuration of a wet play structure according to an embodiment of the present invention.

FIG. 38 illustrates a top view of a wet play structure 100 including a tipping bucket 212.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus and methods. The steps of the method or algorithm may also be performed in an alternate order from those provided in the examples.

What is claimed is:

1. A wet play structure for traversal by a user comprising:
a non-harnessed course; and
a harnessed course adjacent to the non-harnessed course, the harnessed course including:
a harness configured to be connected with the user,
a track configured to connect to the harness via an attachment unit, the attachment unit comprising a puck,
a sensing component configured to detect presence of the harness at a first location along the track,
a fluid conduit configured to transmit water to the first location in response to the sensing component detecting presence of the harness at the first location; and
a zip-line configured to connect to the harness via the attachment unit, wherein the attachment unit is configured to transition from the track to the zip-line without requiring the user to remove the harness or the attachment unit.

2. The wet play structure of claim 1 wherein the track ends adjacent to a starting location of the zip-line such that the attachment unit is configured to move from the track to the zip-line.

3. A wet play structure comprising:
an elevated path configured to allow a user to traverse the elevated path;
a track configured to connect to a harness via a puck, the harness worn by the user while the user traverses the elevated path;
a zip-line configured to connect to the harness worn by the user, wherein the harness can move from the track to the zip-line such that the user does not have to remove the harness in order to transition from the track to the zip-line;
a radio frequency identification reader configured to cooperate with a radio frequency identification unit associated with the user for detecting presence of the user at a first location on the first track; and
a fluid conduit positioned to transmit water onto the user before the water is permitted onto the elevated path while the user traverses the elevated path, the fluid conduit configured to transmit water onto the user in response to the radio frequency identification reader detecting presence of the user at the first location.

4. The wet play structure of claim 3, wherein the elevated path includes an obstacle, the obstacle selected from the group consisting of a rail for the user to step on to traverse the elevated path, a movable bridge for the user to step on to traverse the elevated path, pods the user steps on to traverse the elevated path, a rope for the user to step on to traverse the elevated path, monkey bars for the user to grip to traverse the elevated path, and combinations thereof.

5. The wet play structure of claim 3, wherein the track is positioned above the elevated path.

6. The wet play structure of claim 3, wherein the fluid conduit is selected from the group consisting of a water shooting device, a water spray device, a water dispersion unit, a tipping bucket, a waterfall, and combinations thereof.

7. The wet play structure of claim 3, wherein the elevated path is configured as a first elevated path and a second elevated path positioned above the first elevated path.

8. The wet play structure of claim 3, wherein the track is tethered to the harness such that the track stops a falling motion of the user if the user falls from the elevated path.

9. A wet play structure comprising:
an elevated path configured to allow a user to traverse the elevated path, the elevated path having a first elevated path and a second elevated path positioned at an elevation higher than the first elevated path;
a track for connecting to a harness via an attachment unit, the harness worn by the user while the user traverses the elevated path;
a zip-line for connecting to the harness via the attachment unit, wherein the user moves from the track to the zip-line without requiring removing the harness or the attachment unit;
a radio frequency identification unit coupled with the attachment unit;
a radio frequency identification reader for detecting presence of the radio frequency identification unit at a location along the elevated path;
an obstacle included with the elevated path, wherein the user traversing the elevated path interacts with the obstacle; and
a pool positioned beneath the elevated path and configured to contain water.

10. The wet play structure of claim 9, wherein the obstacle is selected from the group consisting of a rail for the user to step on to traverse the elevated path, a movable bridge for the user to step on to traverse the elevated path, pods the user steps on to traverse the elevated path, a rope for the user to step on to traverse the elevated path, monkey bars for the user to grip to traverse the elevated path, and combinations thereof.

11. The wet play structure of claim 9, wherein the track is positioned above the elevated path.

12. The wet play structure of claim 9, wherein the track is tethered to the harness such that the track stops a falling motion of the user if the user falls from the elevated path.

13. The wet play structure of claim 9, wherein the pool is positioned such that the user contacts water in the pool if the user falls from the elevated path.

* * * * *